US011168459B2

(12) United States Patent
Narikawa et al.

(10) Patent No.: US 11,168,459 B2
(45) Date of Patent: Nov. 9, 2021

(54) WORK MACHINE

(71) Applicant: HITACHI CONSTRUCTION MACHINERY CO., LTD., Tokyo (JP)

(72) Inventors: Ryu Narikawa, Tokyo (JP); Manabu Edamura, Tsuchiura (JP); Hiroshi Sakamoto, Tsuchiura (JP); Shiho Izumi, Tsuchiura (JP); Hidekazu Moriki, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 201 days.

(21) Appl. No.: 16/344,367

(22) PCT Filed: Nov. 8, 2017

(86) PCT No.: PCT/JP2017/040321
§ 371 (c)(1),
(2) Date: Apr. 24, 2019

(87) PCT Pub. No.: WO2018/168062
PCT Pub. Date: Sep. 20, 2018

(65) Prior Publication Data

US 2020/0048861 A1 Feb. 13, 2020

(30) Foreign Application Priority Data

Mar. 15, 2017 (JP) ..... JP2017-049397

(51) Int. Cl.
*E02F 3/43* (2006.01)
*E02F 9/22* (2006.01)

(52) U.S. Cl.
CPC ..... *E02F 3/431* (2013.01); *E02F 9/2246* (2013.01)

(58) Field of Classification Search
CPC ..... E02F 3/43; E02F 3/431; E02F 9/20; E02F 9/2246
See application file for complete search history.

(56) References Cited

U.S. PATENT DOCUMENTS 5,799,419 A 9/1998 Seo et al.
5,816,335 A * 10/1998 Yamamoto ..... E02F 9/2029 172/4.5

(Continued)

FOREIGN PATENT DOCUMENTS

EP 0 512 584 A2 11/1992
GB 2 306 705 A 5/1997

(Continued)

OTHER PUBLICATIONS

International Preliminary Report on Patentabiltiy received in corresponding International Application No. PCT/JP2017/040321 dated Sep. 26, 2019.

(Continued)

*Primary Examiner* — Babar Sarwar
(74) *Attorney, Agent, or Firm* — Mattingly & Malur, PC

(57) ABSTRACT

Provided is a hydraulic excavator (1) that performs work by operating an arm (9) after moving a bucket (10) to a work start position. An operation determination section (81*c*) determines, based on an operation performed on an operation device, whether a front work device (1A) is engaged in a work preparation operation for moving the bucket to the work start position. When the operation determination section determines that the front work device is engaged in the work preparation operation at the time of operation of the operation device, an actuator control section (81) controls a bucket cylinder (7) such that the angle of a work tool with respect to a target surface coincides with a preset target angle (θTGT).

7 Claims, 23 Drawing Sheets

(56) References Cited

U.S. PATENT DOCUMENTS 5,913,811 A * 6/1999 Kinugawa ..... E02F 9/207 60/420
5,950,141 A * 9/1999 Yamamoto ..... E02F 9/2292 702/41
6,635,973 B1 * 10/2003 Kagoshima ..... E02F 9/2075 307/10.1
8,716,973 B1 * 5/2014 Lammertse ..... B25J 9/1694 318/671
8,994,519 B1 * 3/2015 Fuchs ..... G01C 21/3407 340/435
10,458,095 B2 * 10/2019 Caillieret ..... E02F 9/2079
10,533,303 B2 * 1/2020 Tsuchie ..... E02F 9/2271
2006/0124323 A1 * 6/2006 Glover ..... E02F 9/26 172/2
2008/0201045 A1 * 8/2008 Kagoshima ..... E02F 9/2075 701/50
2009/0293322 A1 * 12/2009 Faivre ..... G05D 1/0891 37/348
2010/0201180 A1 * 8/2010 Maynard ..... E21C 41/18 299/18
2012/0245760 A1 * 9/2012 Ikeya ..... B60R 1/00 701/1
2013/0318956 A1 * 12/2013 Yunoue ..... E02F 9/2091 60/420
2014/0046552 A1 * 2/2014 Tsuruga ..... B60L 1/003 701/50
2014/0083089 A1 * 3/2014 Wutke ..... F15B 15/18 60/327
2014/0205412 A1 * 7/2014 Bienfang ..... E02F 3/425 414/697
2016/0002882 A1 1/2016 Kanari et al.
2016/0145832 A1 * 5/2016 Stockhaus ..... E02F 3/3677 414/694
2017/0284070 A1 10/2017 Matsuyama et al.
2017/0314234 A1 * 11/2017 Paull ..... E02F 9/2228
2017/0356157 A1 * 12/2017 Caillieret ..... E02F 9/2095
2018/0230671 A1 * 8/2018 Wu ..... E02F 3/32

FOREIGN PATENT DOCUMENTS

JP 4-27029 A 1/1992
JP 11-001937 A 1/1999
JP 2000-303492 A 10/2000
JP 2015-055109 A 3/2015
JP 2017-008719 A 1/2017
WO 2016/129708 A1 8/2016

OTHER PUBLICATIONS

International Search Report of PCT/JP2017/040321 dated Jan. 23, 2018.
Extended European Search Report received in corresponding European Application No. 17901028.5 dated Mar. 16, 2021.

* cited by examiner

WORK MACHINE

TECHNICAL FIELD

The present invention relates to a work machine that controls at least one of a plurality of hydraulic actuators under predetermined conditions when an operation device is operated.

BACKGROUND ART

Machine control (MC) is a technology that increases the work efficiency of a work machine (e.g., a hydraulic excavator) having a work device (e.g., a front work device) driven by a hydraulic actuator. The MC is a technology that provides operational assistance to an operator by executing semi-automatic control for operating the work device under predetermined conditions when an operation device is operated by the operator. "Executing MC" may be hereinafter simply referred to as "MCing."

A technology disclosed, for example, in a patent document named "JP-2000-303492-A" sets a target posture of a bucket (work tool), and provides MCing of a front work device in such a manner as to move the bucket in the target posture along a target excavation surface (hereinafter may be referred to also as a target surface). According to this patent document, as regards the setting of a target bucket posture (a bucket angle with respect to the target surface), the position of the toe of the bucket and the bucket angle in a case where an operation lever of an operation lever device for an arm (arm operation lever) is in neutral are always regarded as the bucket angle with respect to the target surface. Further, this patent document assumes that MC starts at the point in time when the arm operation lever is operated from its neutral position and ends at the point in time when the arm operation lever returns to its neutral position. That is to say, a bucket posture at the beginning of an arm operation is set as the target bucket posture (the bucket angle with respect to the target surface), and MC is executed so as to maintain the bucket in its target posture during the arm operation.

PRIOR ART DOCUMENT

Patent Document

Patent Document 1: JP-2000-303492-A

SUMMARY OF THE INVENTION

Problem to be Solved by the Invention

According to the above patent document, the bucket posture at the point in time when the arm operation is started by the operator is set as the bucket angle with respect to the target surface during MC. That is to say, MC is not executed so as to set the bucket angle with respect to the target surface (referred to as the "bucket angle with respect to the ground" in Patent Document 1) to a predetermined value. Therefore, in order to set the bucket angle with respect to the target surface during MC to a desired value, the bucket angle with respect to the target surface needs to be adjusted by the operator before the start of the arm operation. However, it is difficult for the operator to visually check the bucket angle with respect to the target surface during such an angle adjustment. Consequently, it requires skills to set the bucket angle with respect to the target surface to a desired value.

Further, MC may give an uncomfortable feeling to the operator because it provides an operation that intervenes with an operation performed by the operator. Therefore, wherever possible, MC should preferably be initiated at a point in time that does not give an uncomfortable feeling to the operator.

An object of the present invention is to provide a work machine that is capable of easily setting the angle of a work tool, such as a bucket, with respect to a target surface to a desired value without giving an uncomfortable feeling to an operator wherever possible.

Means for Solving the Problem

In accomplishing the above object, according to the present invention, there is provided a work machine that performs work by operating an arm after moving a work tool to a work start position. The work machine includes a work device, a plurality of hydraulic actuators, an operation device, and a control device. The work device includes a boom, the arm, and the work tool. The hydraulic actuators drive the work device. The operation device instructs the work device to operate in accordance with an operator's operation. The control device includes an actuator control section that controls at least one of the hydraulic actuators under predetermined conditions at a time of operation of the operation device is operated. The control device further includes an operation determination section that determines, based on an operation performed on the operation device, whether the work device is engaged in a work preparation operation for moving the work tool to the work start position. When the operation determination section determines that the work device is engaged in the work preparation operation at the time of operation of the operation device, the actuator control section executes machine control to control a target hydraulic actuator such that an angle of the work tool with respect to a target surface indicative of a target shape of a work target for the work device coincides with a preset target angle. The target hydraulic actuator is one of the hydraulic actuators and related to the work tool.

Advantages of the Invention

When a work tool is to be positioned with respect to a target surface as needed at the beginning of excavation or other work, the present invention makes it possible to quickly adjust the angle of the work tool for the target surface without causing an uncomfortable feeling, and thus provide increased work efficiency.

MODES FOR CARRYING OUT THE INVENTION

Figure 1:
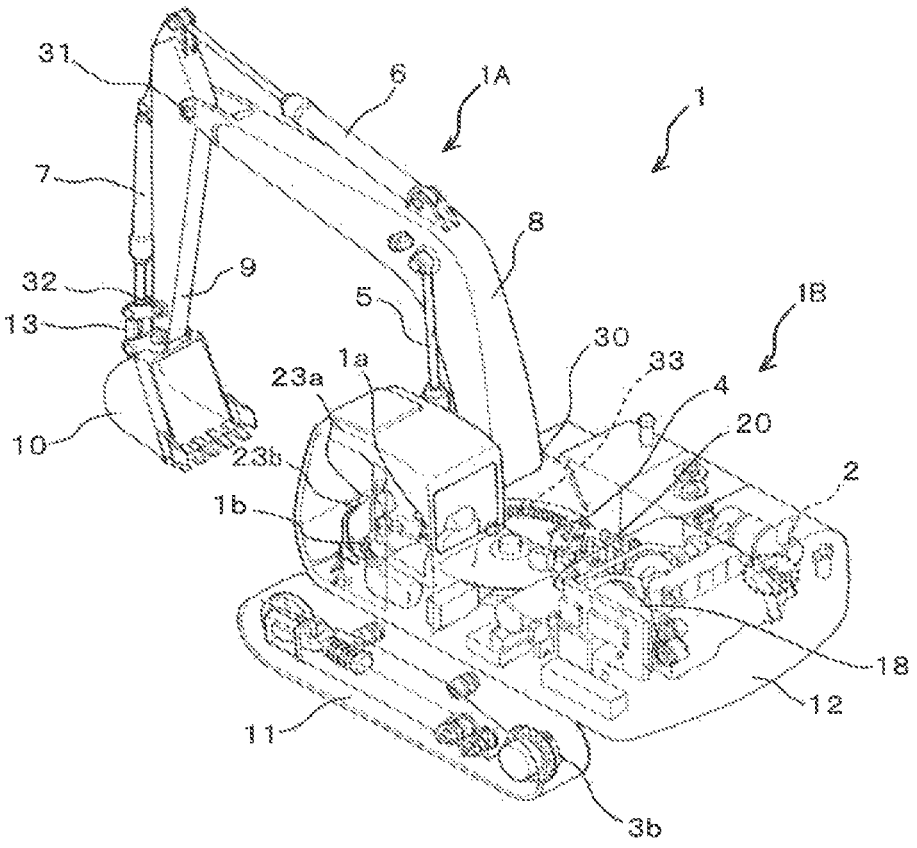
FIG. 1 is a diagram illustrating a configuration of a hydraulic excavator.

Embodiments of the present invention will now be described with reference to the accompanying drawings. Exemplified in the following description is a hydraulic excavator having a bucket 10 as a work tool (an attachment) at the tip of a work device. However, the present invention may be applied to a work machine having an attachment other than a bucket. Further, the present invention is also applicable to a work machine other than a hydraulic excavator as far as the work machine includes a multi-joint work device that is formed by coupling a plurality of link members (an attachment, an arm, a boom, etc.).

Meanwhile, this document uses "on," "above," or "below" together with a term indicative of a certain shape (e.g., a target surface or a design surface). The word "on" indicates the "surface" of such a certain shape, the word "above" indicates a "position higher than the surface" of such a certain shape, and the word "below" indicates a "position lower than the surface" of such a certain shape. Further, in the following description, a plurality of identical elements may be designated by reference characters (signs or numerals) suffixed with an alphabetical letter. In some cases, however, the plurality of identical elements may be designated collectively without using such an alphabetical suffix. For example, when three pumps 300*a*, 300*b*, and 300*c* exist, they may be collectively designated as the pumps 300.

Embodiment 1

<Basic Configuration>

Figure 2:
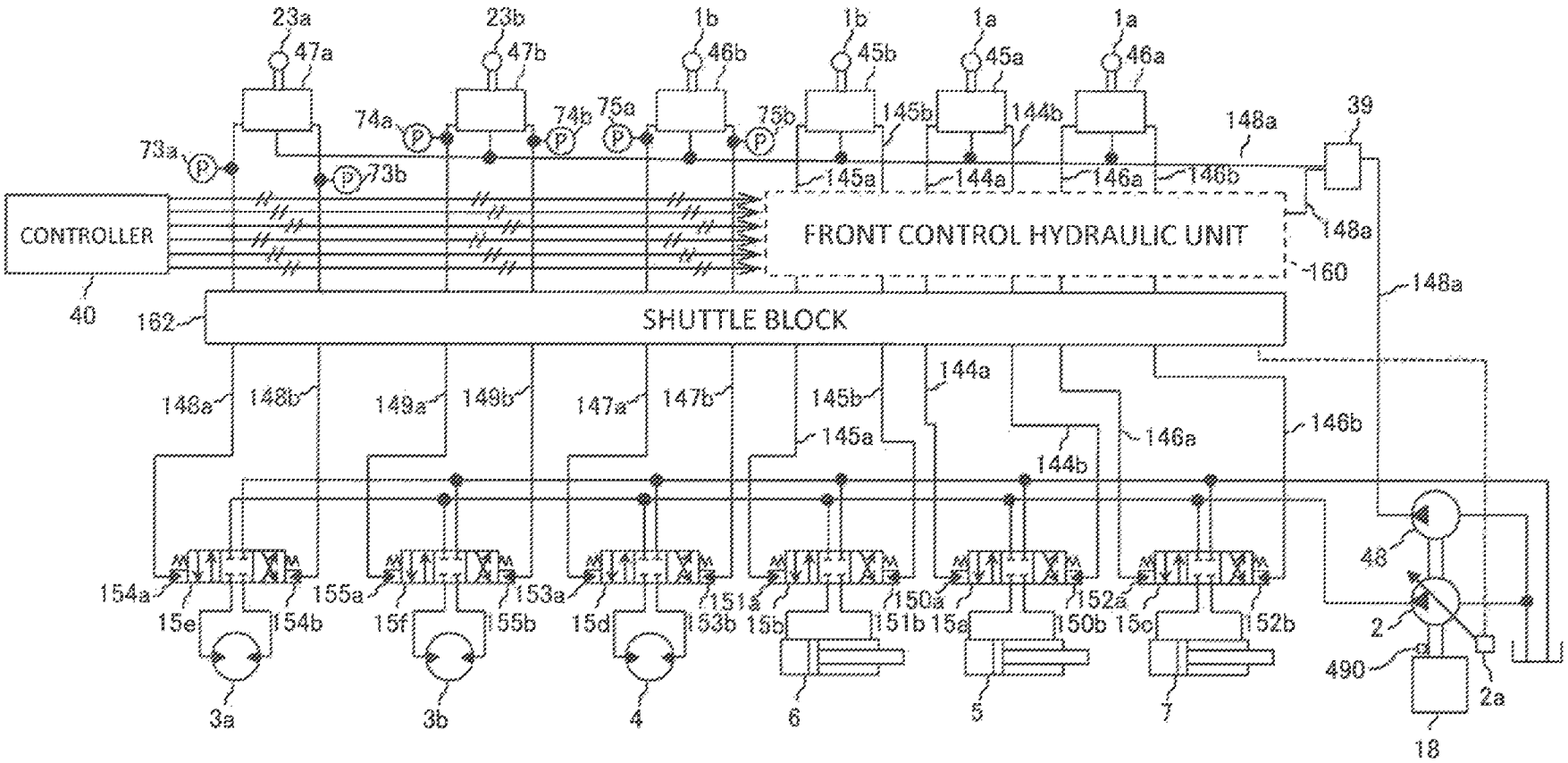
FIG. 2 is a diagram illustrating a controller for the hydraulic excavator and a hydraulic drive system.
Figure 3:
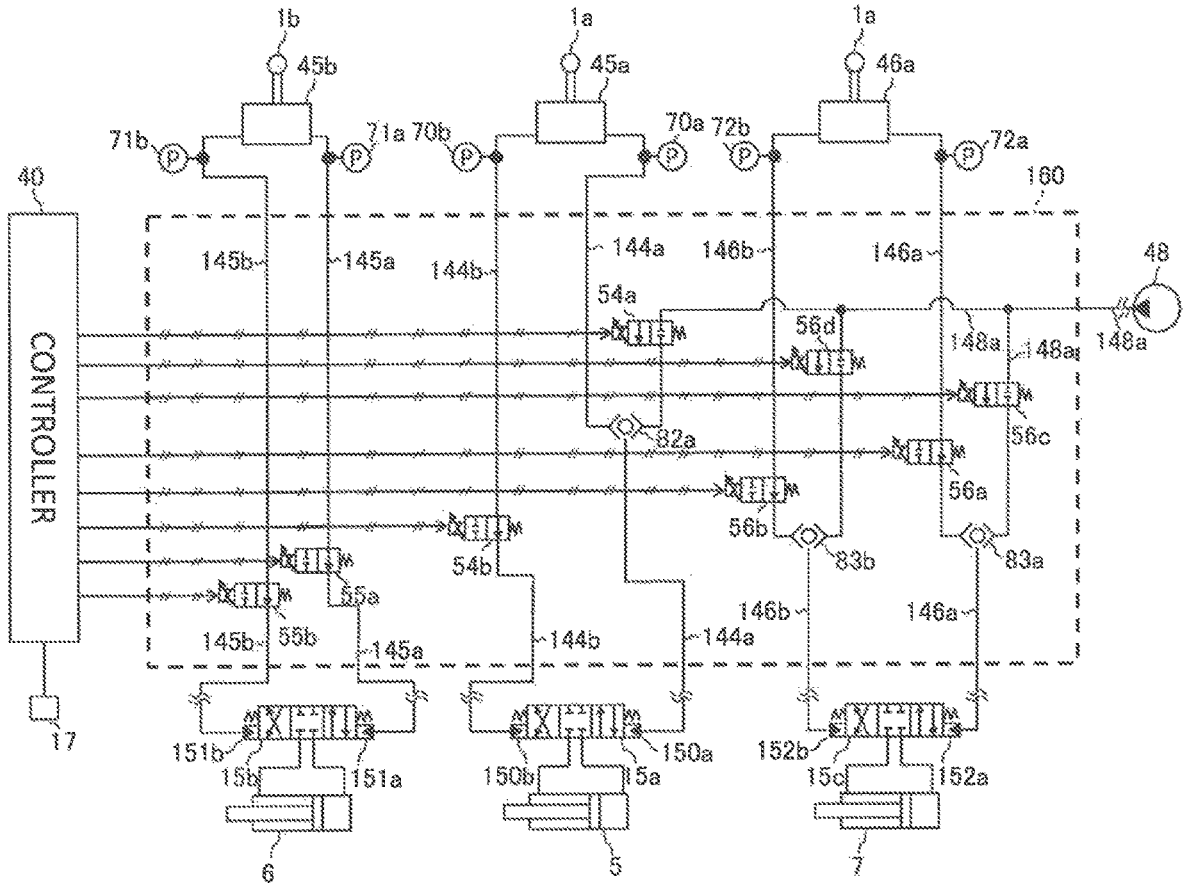
FIG. 3 is a diagram illustrating the details of a front control hydraulic unit.

FIG. 1 is a diagram illustrating a configuration of a hydraulic excavator according to Embodiment 1 of the present invention. FIG. 2 is a diagram illustrating a hydraulic drive system and a controller for the hydraulic excavator according to an embodiment of the present invention. FIG. 3 is a diagram illustrating the details of a front control hydraulic unit 160 depicted in FIG. 2.

Referring to FIG. 1, the hydraulic excavator 1 includes a multi-joint front work device 1A and a machine body 1B. The machine body 1B includes a lower travel structure 11 and an upper swing structure 12. Left and right travel hydraulic motors 3*a* and 3*b* cause the lower travel structure 11 to travel. The upper swing structure 12 is mounted on the lower travel structure 11 and swung by a swing hydraulic motor 4.

The front work device 1A is formed by coupling a plurality of driven members (a boom 8, an arm 9, and a bucket 10), which pivot independently from each other in the vertical direction. The base end of the boom 8 is pivotally supported through a boom pin at the front of the upper swing structure 12. The arm 9 is pivotally coupled to the tip of the boom 8 through an arm pin. The bucket 10 is pivotally coupled to the tip of the arm 9 through a bucket pin. The boom 8 is driven by a boom cylinder 5, the arm 9 is driven by an arm cylinder 6, and the bucket 10 is driven by a bucket cylinder 7.

In such a manner as to be able to measure pivot angles α, β, and γ (see FIG. 5) of the boom 8, arm 9, and bucket 10, a boom angle sensor 30 is attached to the boom pin, an arm angle sensor 31 is attached to the arm pin, and a bucket angle sensor 32 is attached to a bucket link 13. A machine body inclination angle sensor 33 is attached to the upper swing structure 12 in order to detect the inclination angle θ (see FIG. 5) of the upper swing structure 12 (machine body 1B) with respect to a reference plane (e.g., horizontal plane). Each of the angle sensors 30, 31, and 32 may be substituted by an angle sensor that measures the angle with respect to the reference plane (e.g., horizontal plane).

Installed in a cab mounted on the upper swing structure 12 are an operation device 47*a* (FIG. 2), an operation device 47*b* (FIG. 2), operation devices 45*a* and 46*a* (FIG. 2), and operation devices 45*b* and 46*b* (FIG. 2). The operation device 47*a* includes a travel right lever 23*a* (FIG. 1) and operates a travel right hydraulic motor 3*a* (lower travel structure 11). The operation device 47*b* includes a travel left lever 23*b* (FIG. 1) and operates a travel left hydraulic motor 3*b* (lower travel structure 11). The operation devices 45*a* and 46*a* share an operation right lever 1*a* (FIG. 1) and operate the boom cylinder 5 (boom 8) and the bucket cylinder 7 (bucket 10). The operation devices 45*b* and 46*b* share an operation left lever 1*b* (FIG. 1) and operate the arm cylinder 6 (arm 9) and the swing hydraulic motor 4 (upper swing structure 12). The travel right lever 23*a*, the travel left lever 23*b*, the operation right lever 1*a*, and the operation left lever 1*b* may be hereinafter generically referred to as the operation levers 1 and 23.

An engine 18 mounted in the upper swing structure 12 acts as a prime mover and drives a hydraulic pump 2 and a pilot pump 48. The hydraulic pump 2 is a variable displacement pump, and its displacement is controlled by a regulator 2*a*. The pilot pump 48 is a fixed displacement pump. In the present embodiment, as depicted in FIG. 3, a shuttle block 162 is disposed in the middle of pilot lines 144, 145, 146, 147, 148, and 149. Hydraulic signals outputted from the operation devices 45, 46, and 47 are additionally inputted to the regulator 2*a* through the shuttle block 162. Although the detailed configuration of the shuttle block 162 is not described here, the hydraulic signals are inputted to the regulator 2*a* through the shuttle block 162 so as to control the delivery flow rate of the hydraulic pump 2 in accordance with the hydraulic signals.

A pump line 148*a* is a delivery piping for the pilot pump 48. The pump line 148*a* runs through a lock valve 39, then branches into a plurality of lines, and connects to various valves in the operation devices 45, 46, and 47 and in the front control hydraulic unit 160. The lock valve 39 is a solenoid selector valve in the present example, and its solenoid drive section is electrically connected to a position sensor of a gate lock lever (not depicted) disposed in the cab (FIG. 1). The position of the gate lock lever is detected by the position sensor, and a signal based on the position of the gate lock lever is inputted from the position sensor to the lock valve 39. If the gate lock lever is in a lock position, the lock valve 39 closes to close the pump line 148*a*. If, by contrast, the gate lock lever is in an unlock position, the lock valve 39 opens to open the pump line 148*a*. That is to say, while the pump line 148*a* is closed, operations performed by the operation devices 45, 46, and 47 are invalidated to prohibit operations such as swinging and excavating.

The operation devices 45, 46, and 47 are of a hydraulic pilot type, and generate a pilot pressure (may be referred to as the operating pressure) based on the hydraulic fluid delivered from the pilot pump 48 in accordance with the operation amount (e.g., lever stroke) and operation direction of the operation levers 1 and 23 operated by an operator. The pilot pressure generated in the above manner is supplied to associated hydraulic drive sections 150*a* to 155*b* of flow control valves 15*a* to 15*f* (see FIG. 2 or 3) in a control valve unit 20 through the pilot lines 144*a* to 149*b* (see FIG. 3), and used as a control signal for driving the flow control valves 15*a* to 15*f*.

The hydraulic fluid delivered from the hydraulic pump 2 is supplied to the travel right hydraulic motor 3*a*, the travel left hydraulic motor 3*b*, the swing hydraulic motor 4, the boom cylinder 5, the arm cylinder 6, and the bucket cylinder 7 through the flow control valves 15*a*, 15*b*, 15*c*, 15*d*, 15*e*, and 15*f* (see FIG. 3). The supplied hydraulic fluid expands and contracts the boom cylinder 5, the arm cylinder 6, and the bucket cylinder 7, and thus pivots the boom 8, the arm 9, and the bucket 10. This varies the position and posture of the bucket 10. Further, the supplied hydraulic fluid rotates the swing hydraulic motor 4 and thus swings the upper swing structure 12 with respect to the lower travel structure 11. Moreover, the supplied hydraulic fluid rotates the travel right hydraulic motor 3*a* and the travel left hydraulic motor 3*b*. This causes the lower travel structure 11 to travel.

Figure 4:
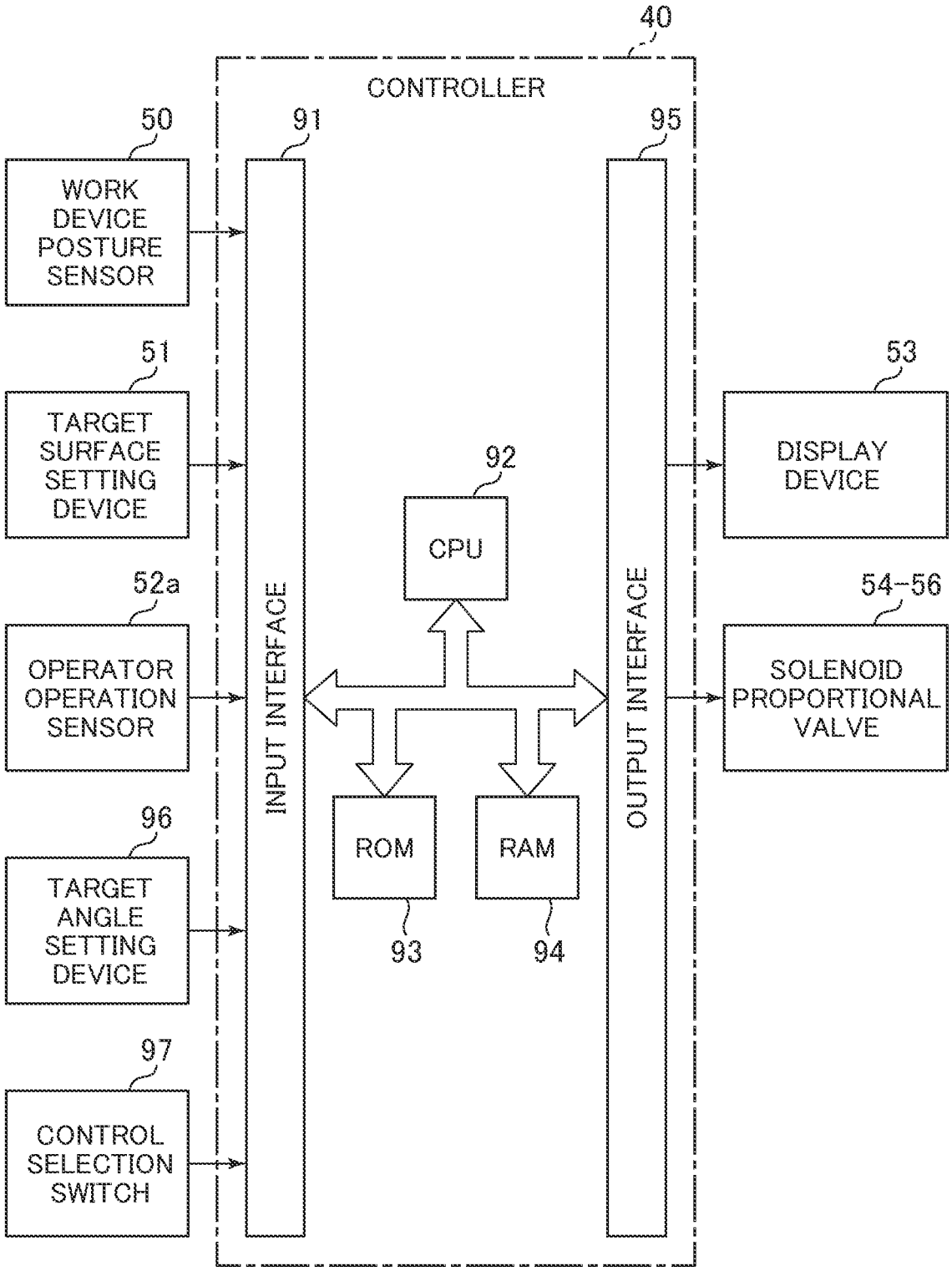
FIG. 4 is a hardware configuration diagram illustrating the controller for the hydraulic excavator.

FIG. 4 is a diagram illustrating a configuration of a machine control (MC) system included in the hydraulic excavator according to the present embodiment. When the operation devices 45 and 46 are operated by the operator, the system depicted in FIG. 4 executes MC, that is, performs a process of controlling the front work device 1A under predetermined conditions. In this document, machine control (MC) may be referred to as "semi-automatic control" in which the operation of the front work device 1A is computer-controlled only when the operation devices 45 and 46 are operated, whereas "automatic control" is executed to computer-control the operation of the front work device 1A when the operation devices 45 and 46 are not operated. MC according to the present embodiment will be described in detail below.

As MC of the front work device 1A, when an excavation operation (more specifically, an instruction for at least one of arm crowding, bucket crowding, and bucket dumping) is inputted through an operation device 45*b*, 46*a*, based on the positional relationship between a target surface 60 (see FIG. 5) and the tip of the front work device 1A (the claw tip of the bucket 10 in the present embodiment), a control signal for forcing at least one of the hydraulic actuators 5, 6, and 7 to operate (e.g., for expanding the boom cylinder 5 to forcibly perform a boom raising operation) is outputted to an associated flow control valve 15*a*, 15*b*, 15*c* so that the position of the tip of the front work device 1A is held on the target surface 60 and in a region above the target surface 60.

Executing MC in the above manner prevents the claw tip of the bucket 10 from intruding into a position below the target surface 60. Therefore, an excavation operation can be performed along the target surface 60 without regard to the skill of the operator. In the present embodiment, a control point for the front work device 1A during MC is set at the claw tip of the bucket 10 (at the tip of the front work device 1A) of the hydraulic excavator. However, the control point may be set at a point other than the claw tip of the bucket as far as it is a point of the tip portion of the front work device 1A. For example, the bottom surface of the bucket 10 or the outermost portion of the bucket link 13 is selectable as the control point.

The system depicted in FIG. 4 includes a work device posture sensor 50, a target surface setting device 51, an operator operation sensor 52*a*, a display device (e.g., liquid-crystal display) 53, a control selection switch (control selection device) 97, a target angle setting device 96, and a controller 40. The display device 53 is installed in the cab and capable of displaying the positional relationship between the target surface 60 and the front work device 1A. The control selection switch 97 selectively enables or disables an MC function of bucket angle control (referred to also as work tool angle control). The target angle setting device 96 sets the angle (target angle) of the bucket 10 with respect to the target surface 60 during MC for bucket angle control. The controller 40 is a computer that provides MC.

The work device posture sensor 50 includes the boom angle sensor 30, the arm angle sensor 31, the bucket angle sensor 32, and the machine body inclination angle sensor 33. Each of these angle sensors 30, 31, 32, and 33 functions as a posture sensor for the front work device 1A.

The target surface setting device 51 is an interface that is capable of inputting information concerning the target surface 60 (information including the position information and inclination angle information about each target surface). The target surface setting device 51 is connected to an external terminal (not depicted) that stores three-dimensional data concerning a target surface defined on a global coordinate system (absolute coordinate system). A target surface may be manually inputted by the operator through the target surface setting device 51.

The operator operation sensor 52*a* includes pressure sensors 70*a*, 70*b*, 71*a*, 71*b*, 72*a*, and 72*b*. The pressure sensors 70*a*, 70*b*, 71*a*, 71*b*, 72*a*, and 72*b* acquire an operating pressure (first control signal) that is generated in the pilot lines 144, 145, and 146 when the operator operates the operation levers 1*a* and 1*b* (operation devices 45*a*, 45*b*, and 46*a*). That is to say, the operator operation sensor 52*a* detects an operation performed on the hydraulic cylinders 5, 6, and 7 related to the front work device 1A.

The control selection switch 97 is disposed, for example, on the front upper end of the operation lever 1*a* shaped like a joystick. The control selection switch 97, which is depressed by the thumb of the operator gripping the operation lever 1*a*, is a momentary switch. Pressing the control selection switch 97 alternately enables (turns on) and disables (turn off) a bucket angle control (work tool angle control) function. The position in which the control selection switch 97 is placed (the ON or OFF position) is inputted to the controller 40. The control selection switch 97 need not always be disposed on the operation lever 1*a* (1*b*), but may be disposed at a different location.

The target angle setting device 96 is an interface that is capable of inputting the angle formed between the target surface 60 and the bottom surface 10*a* of the bucket 10 (this angle is hereinafter referred to also as the "bucket angle with respect to target surface θTGT"). For example, a rotary switch (dial switch) for selecting a desired angle from a plurality of different angles may be used as the target angle setting device 96. The setting of the bucket angle with respect to target surface θTGT may be manually inputted by the operator through the target angle setting device 96, provided with an initial value, or acquired from the outside. The bucket angle with respect to target surface θTGT, which is set by the target angle setting device 96, is inputted to the controller 40.

The control selection switch 97 and the target angle setting device 96 need not always be formed of hardware. For example, an alternative is to adopt a touch panel display device 53 and implement the control selection switch 97 and the target angle setting device 96 by using a graphical user interface (GUI) displayed on the screen of the touch panel display device 53.

<Front Control Hydraulic Unit 160>

As illustrated in FIG. 3, the front control hydraulic unit 160 includes the pressure sensors 70*a* and 70*b*, a solenoid proportional valve 54*a*, a shuttle valve 82*a*, and a solenoid proportional valve 54*b*. The pressure sensors 70*a* and 70*b* are disposed in the pilot lines 144*a* and 144*b* of the operation device 45*a* for the boom 8, and detect a pilot pressure (first control signal) as the operation amount of the operation lever 1*a*. The solenoid proportional valve 54*a* has a primary port side connected to the pilot pump 48 through the pump line 148*a*, reduces the pilot pressure from the pilot pump 48, and outputs the reduced pilot pressure. The shuttle valve 82*a* is connected to the pilot line 144*a* of the operation device 45*a* for the boom 8 and to the secondary port side of the solenoid proportional valve 54*a*, selects a higher pressure out of the pilot pressure in the pilot line 144*a* and a control pressure (second control signal) outputted from the solenoid proportional valve 54*a*, and directs the selected pressure to the hydraulic drive section 150*a* of the flow control valve 15*a*. The solenoid proportional valve 54*b* is installed in the pilot line 144*b* of the operation device 45*a* for the boom 8, reduces the pilot pressure (first control signal) in the pilot line 144*b* in accordance with a control signal from the controller 40, and outputs the reduced pilot pressure.

Further, the front control hydraulic unit 160 includes the pressure sensors 71*a* and 71*b*, a solenoid proportional valve 55*b*, and a solenoid proportional valve 55*a*. The pressure sensors 71*a* and 71*b* are installed in the pilot lines 145*a* and 145*b* for the arm 9, detect the pilot pressure (first control signal) as the operation amount of the operation lever 1*b*, and output the detected pilot pressure to the controller 40. The solenoid proportional valve 55*b* is installed in the pilot line 145*b*, reduces the pilot pressure (first control signal) in accordance with a control signal from the controller 40, and outputs the reduced pilot pressure. The solenoid proportional valve 55*a* is installed in the pilot line 145*a*, reduces the pilot pressure (first control signal) in the pilot line 145*a* in accordance with a control signal from the controller 40, and outputs the reduced pilot pressure.

Moreover, the front control hydraulic unit 160 is configured so that the pressure sensors 72*a* and 72*b*, solenoid proportional valves 56*a* and 56*b*, solenoid proportional valves 56*c* and 56*d*, and shuttle valves 83*a* and 83*b* are disposed in the pilot lines 146*a* and 146*b* for the bucket 10. The pressure sensors 72*a* and 72*b* detect the pilot pressure (first control signal) as the operation amount of the operation lever 1*a*, and output the detected pilot pressure to the controller 40. The solenoid proportional valves 56*a* and 56*b* reduce the pilot pressure (first control signal) in accordance with a control signal from the controller 40, and output the reduced pilot pressure. The solenoid proportional valves 56*c* and 56*d* have a primary port side connected to the pilot pump 48, reduce the pilot pressure from the pilot pump 48, and output the reduced pilot pressure. The shuttle valves 83*a* and 83*b* select a higher pressure out of the pilot pressure in the pilot lines 146*a* and 146*b* and a control pressure outputted from the solenoid proportional valve 56*c* and 56*d*, and direct the selected pressure to hydraulic drive sections 152*a* and 152*b* of the flow control valve 15*c*. Connection lines between the pressure sensors 70, 71, and 72 and the controller 40 are omitted from FIG. 3 due to drawing space limitations.

The solenoid proportional valves 54*b*, 55*a*, 55*b*, 56*a*, and 56*b* maximize their openings when de-energized, and reduce their openings with an increase in a current acting as a control signal from the controller 40. Meanwhile, the solenoid proportional valves 54*a*, 56*c*, and 56*d* are closed when de-energized and open when energized. Their openings become larger with an increase in the current (control signal) from the controller 40. In this manner, the openings 54, 55, and 56 of the solenoid proportional valves are based on a control signal from the controller 40.

When the controller 40 outputs a control signal to drive the solenoid proportional valves 54*a*, 56*c*, and 56*d* in the front control hydraulic unit 160 configured as described above, a pilot pressure (second control signal) is generated even if the associated operation devices 45*a* and 46*a* are not operated by the operator. This makes it possible to forcibly perform a boom raising operation, a bucket crowding operation, and a bucket dumping operation. Meanwhile, when the controller 40 similarly drives the solenoid proportional valves 54*b*, 55*a*, 55*b*, 56*a*, and 56*b*, the pilot pressure (second control signal) is generated. The pilot pressure (second control signal) is obtained by reducing the pilot pressure (first control signal) that is generated when the operation devices 45*a*, 45*b*, and 46*a* are operated by the operator. This makes it possible to forcibly reduce the speeds of a boom lowering operation, an arm crowding/dumping operation, and a bucket crowding/dumping operation to values smaller than operator-inputted values.

In this document, a pilot pressure generated by operating the operation devices 45*a*, 45*b*, and 46*a*, which is among the control signals for the flow control valves 15*a* to 15*c*, is referred to as the "first control signal." Further, a pilot pressure generated by allowing the controller 40 to drive the solenoid proportional valves 54*b*, 55*a*, 55*b*, 56*a*, and 56*b* in order to correct (reduce) the first control signal, and a pilot pressure generated newly and separately from the first control signal by allowing the controller 40 to drive the solenoid proportional valves 54*a*, 56*c*, and 56*d*, which are among the control signals for the flow control valves 15*a* to 15*c*, are referred to as the "second control signal."

The second control signal is generated when the speed vector of the control point for the front work device 1A, which is generated by the first control signal, does not meet predetermined conditions. The second control signal is generated as a control signal for generating a speed vector of the control point for the front work device 1A that meets the predetermined conditions. In a case where the first control signal is generated for one hydraulic drive section and the second control signal is generated for the other hydraulic drive section in the same flow control valve 15*a* to 15*c*, it is assumed that the second control signal preferentially works on a hydraulic drive section. Thus, the first control signal is interrupted by a solenoid proportional valve, and the second control signal is inputted to the other hydraulic drive section. Consequently, a flow control valve 15*a* to 15*c* for which the second control signal is computed is controlled based on the second control signal, a flow control valve 15*a* to 15*c* for which the second control signal is not computed is controlled based on the first control signal, and a flow control valve 15*a* to 15*c* for which neither of the first and second control signals is generated is not controlled (not driven). When the first control signal and the second control signal are defined as described above, it can be said that MC controls the flow control valves 15*a* to 15*c* in accordance with the second control signal.

<Controller 40>

Referring to FIG. 4, the controller 40 includes an input section 91, a central processing unit (CPU) 92, which is a processor, a read-only memory (ROM) 93 and a random-access memory (RAM) 94, which are storage devices, and an output section 95. The input section 91 inputs signals from the angle sensors 30 to 32 and the machine body inclination angle sensor 33, which are included in the work device posture sensor 50, a signal from the target surface setting device 51, which sets the target surface 60, a signal from the operator operation sensor 52*a*, which includes the pressure sensors (including the pressure sensors 70, 71, and 72) for detecting the operation amounts from the operation devices 45*a*, 45*b*, and 46*a*, a signal indicative of the position (the enable or disable position) in which the control selection switch 97 is placed, and a signal indicative of the target angle from the target angle setting device 96, and then converts the inputted signals in such a manner that they can be computed by the CPU 92. The ROM 93 is a recording medium that stores, for example, a control program for executing MC including processes described in the later-described flowcharts, and various information necessary for executing the flowcharts. The CPU 92 performs predetermined arithmetic processing on signals acquired from the input section 91 and memories 93 and 94 in accordance with the control program stored in the ROM 93. The output section 95 creates an output signal based on the result of computation by the CPU 92, and outputs the created output signal to the solenoid proportional valves 54 to 56 or the display device 53, thereby driving and controlling the hydraulic actuators 5 to 7 and displaying images, for example, of the machine body 1B, bucket 10, and target surface 60 on a screen of the display device 53.

The controller 40 depicted in FIG. 4 includes, as storage devices, the ROM 93 and the RAM 94, which are semiconductor memories. However, such semiconductor memories may be substituted by any storage device. For example, a hard disk drive or other magnetic storage device may be included as a substitute.

Figure 6:
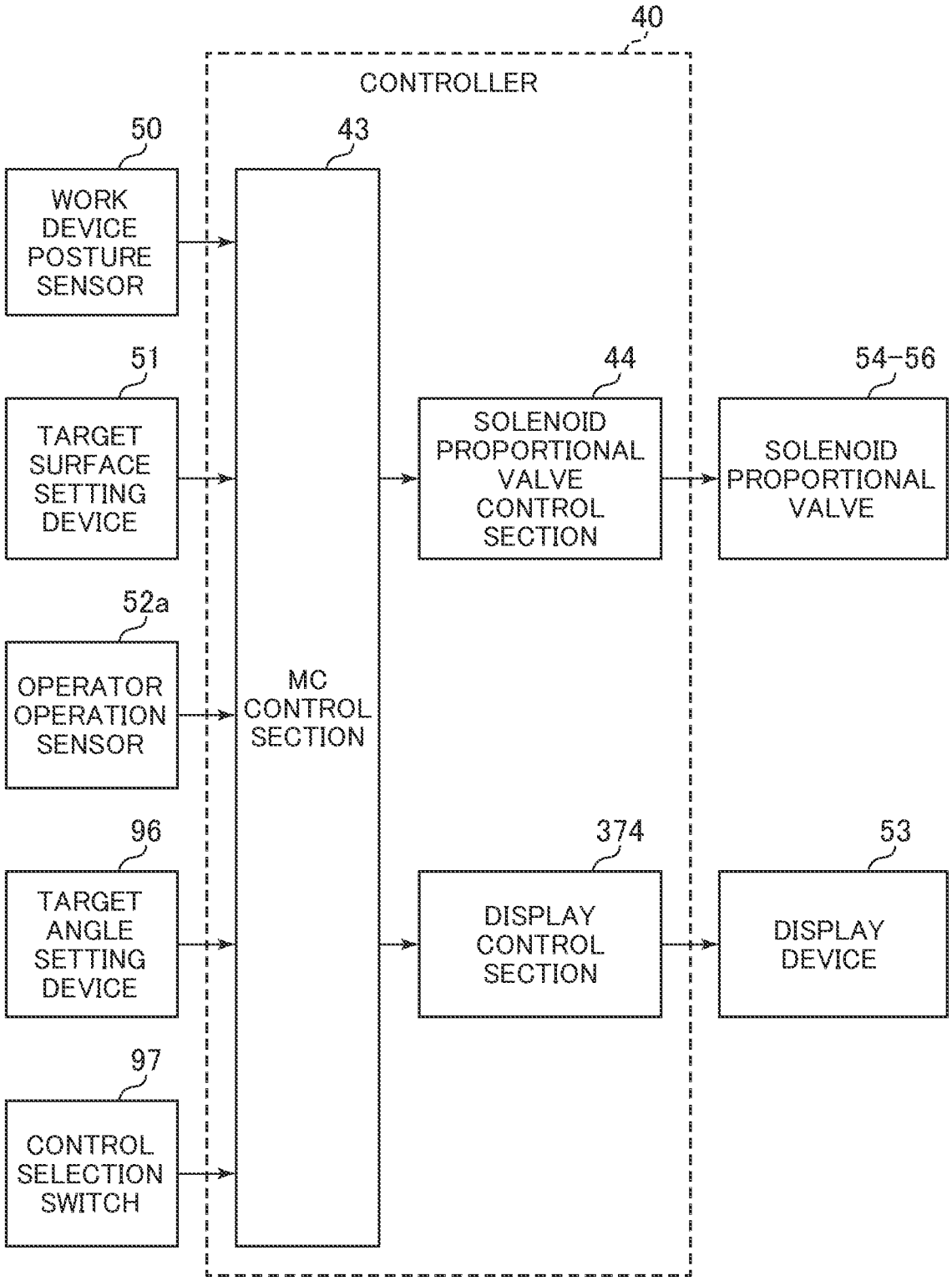
FIG. 6 is a functional block diagram illustrating the controller for the hydraulic excavator depicted in FIG. 1.

FIG. 6 is a functional block diagram illustrating the controller 40. The controller 40 includes an MC control section 43, a solenoid proportional valve control section 44, and a display control section 374.

The display control section 374 controls the display device 53 in accordance with a work device posture and target surface outputted from the MC control section 43. The display control section 374 includes a display ROM that stores a large amount of display data including images and icons of the front work device 1A. The display control section 374 reads a predetermined program based on a flag included in inputted information, and provides display control of the display device 53.

Figure 7:
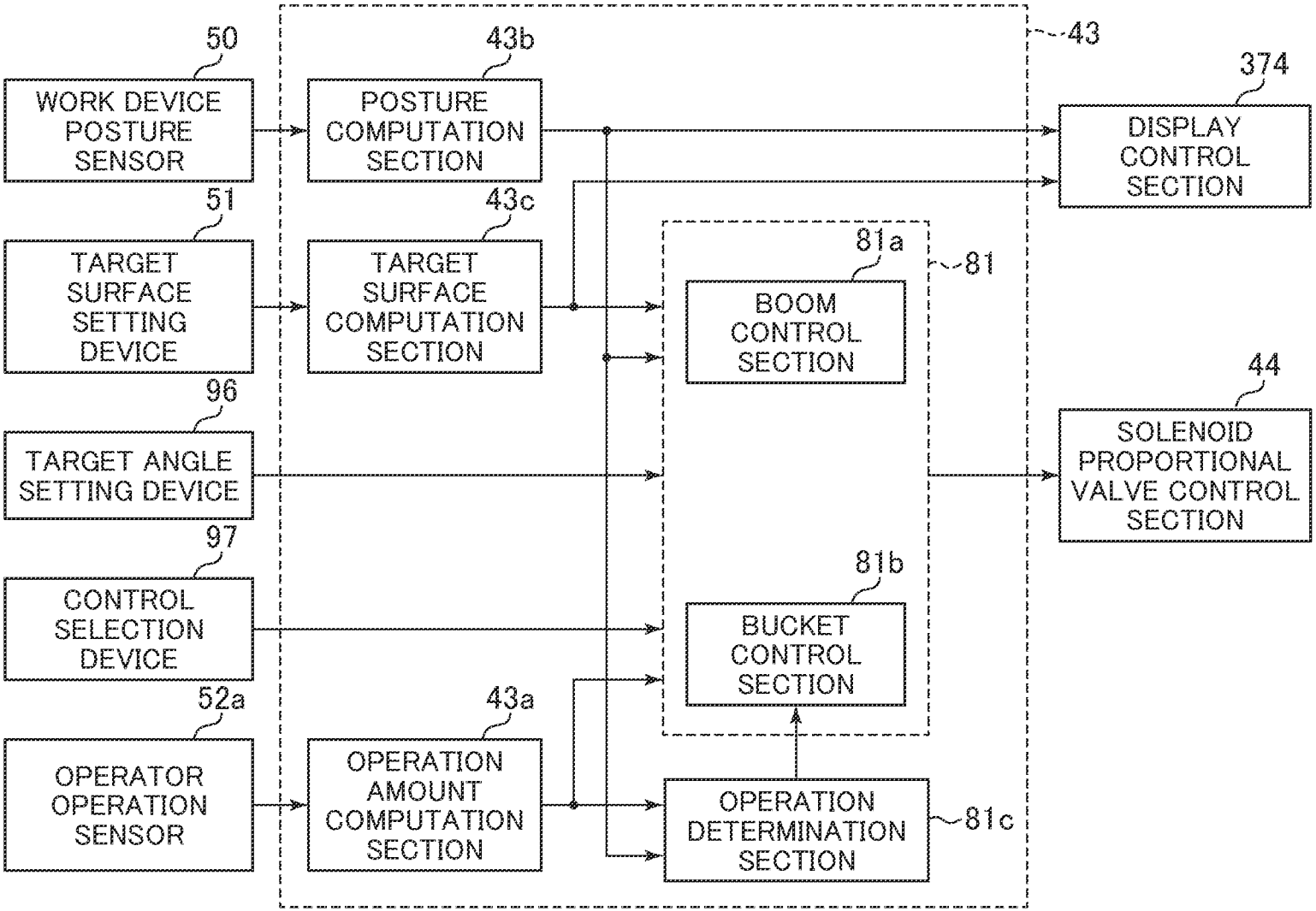
FIG. 7 is a functional block diagram illustrating an MC control section depicted in FIG. 6.

FIG. 7 is a functional block diagram illustrating the MC control section 43 depicted in FIG. 6. The MC control section 43 includes an operation amount computation section 43*a*, a posture computation section 43*b*, a target surface computation section 43*c*, a boom control section 81*a*, a bucket control section 81*b*, and an operation determination section 81*c*.

The operation amount computation section 43*a* calculates the operation amounts of the operation devices 45*a*, 45*b*, and 46*a* (operation levers 1*a* and 1*b*) in accordance with an input from the operator operation sensor 52*a*. The operation amounts of the operation devices 45*a*, 45*b*, and 46*a* can be calculated from the values detected by the pressure sensors 70, 71, and 72.

Using the pressure sensors 70, 71, and 72 for operation amount calculation is merely an example. For example, a position sensor (e.g., rotary encoder) for detecting the rotational displacement of an operation lever for the operation device 45*a*, 45*b*, 46*a* may be used to detect the operation amount of the operation lever. Further, the configuration for calculating an operation speed from an operation amount may be replaced by a configuration in which stroke sensors for detecting the expansion and contraction amounts of the hydraulic cylinders 5, 6, and 7 are installed to calculate the operation speeds of the cylinders in accordance with temporal changes in the detected expansion and contraction amounts.

The posture computation section 43*b* computes, based on information from the work device posture sensor 50, the posture of the front work device 1A and the position of the claw tip of the bucket 10 in a local coordinate system.

Figure 5:
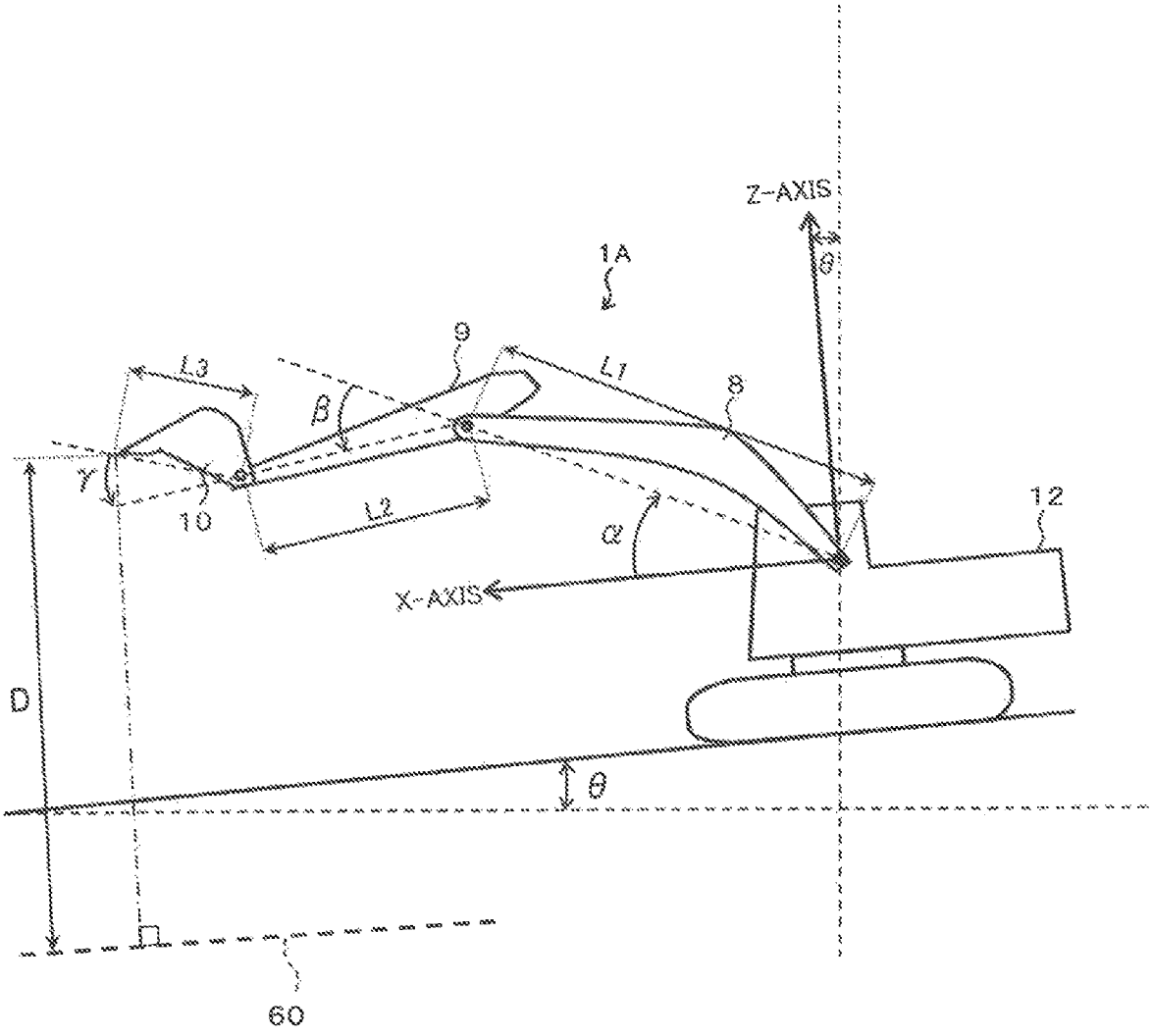
FIG. 5 is a diagram illustrating a coordinate system of the hydraulic excavator depicted in FIG. 1 and a target surface.

The posture of the front work device 1A can be defined in an excavator coordinate system (local coordinate system) depicted in FIG. 5. The excavator coordinate system (XZ coordinate system) depicted in FIG. 5 is a coordinate system set for the upper swing structure 12. The origin of this coordinate system is the base of the boom 8, which is pivotally supported by the upper swing structure 12. The Z-axis of this coordinate system is set in the vertical direction of the upper swing structure 12, and the X-axis is set in the horizontal direction of the upper swing structure 12. It is assumed that the inclination angle of the boom 8 with respect to the X-axis is the boom angle $\alpha$, and that the inclination angle of the arm 9 with respect to the boom 8 is the arm angle $\beta$, and further that the inclination angle of the bucket claw tip with respect to the arm is the bucket angle $\gamma$. It is also assumed that the inclination angle of the machine body 1B (upper swing structure 12) with respect to the horizontal plane (reference plane) is the inclination angle $\theta$. The boom angle $\alpha$ is detected by the boom angle sensor 30, the arm angle $\beta$ is detected by the arm angle sensor 31, the bucket angle $\gamma$ is detected by the bucket angle sensor 32, and the inclination angle $\theta$ is detected by the machine body inclination angle sensor 33. When the lengths of the boom 8, arm 9, and bucket 10 are L1, L2, and L3, respectively, as defined in FIG. 5, the coordinates of the position of the bucket claw tip in the excavator coordinate system and the posture of the front work device 1A can be expressed by L1, L2, L3, α, β, and γ.

The target surface computation section 43*c* computes the position information about the target surface 60 in accordance with information from the target surface setting device 51, and stores the computed position information in the ROM 93. In the present embodiment, a cross-sectional shape obtained by cutting a three-dimensional target surface along a plane on which the front work device 1A moves (the operation plane of the work device) as depicted in FIG. 5 is used as the target surface 60 (two-dimensional target surface).

In the example of FIG. 5, there is one target surface 60. In some cases, however, a plurality of target surfaces may exist. In a case where a plurality of target surfaces exist, an available method is to set, for example, a target surface that is closest to the front work device 1A, a target surface that is positioned below the bucket claw tip, or an optionally selected target surface.

The boom control section 81*a* and the bucket control section 81*b* form an actuator control section 81. The actuator control section controls at least one of a plurality of hydraulic actuators 5, 6, and 7 under predetermined conditions when the operation devices 45*a*, 45*b*, and 46*a* are operated. The actuator control section 81 computes target pilot pressures for the flow control valves 15*a*, 15*b*, and 15*c* of the hydraulic cylinders 5, 6, and 7, and outputs the computed target pilot pressures to the solenoid proportional valve control section 44.

The operation determination section 81*c* determines, based on an operation performed on the operation devices 45*a*, 45*b*, and 46*a*, whether the front work device 1A is engaged in an operation (referred to as the "work preparation operation"), that is, positioned to move the bucket 10 to a start position (referred to as the "work start position") for work (referred to as the "arm work") in which the arm 9 (arm cylinder 6) performs a crowding operation or a dumping operation. The "work preparation operation" is referred to also as a bucket positioning operation or bucket positioning work for moving the bucket 10 to the work start position.

Figure 8:
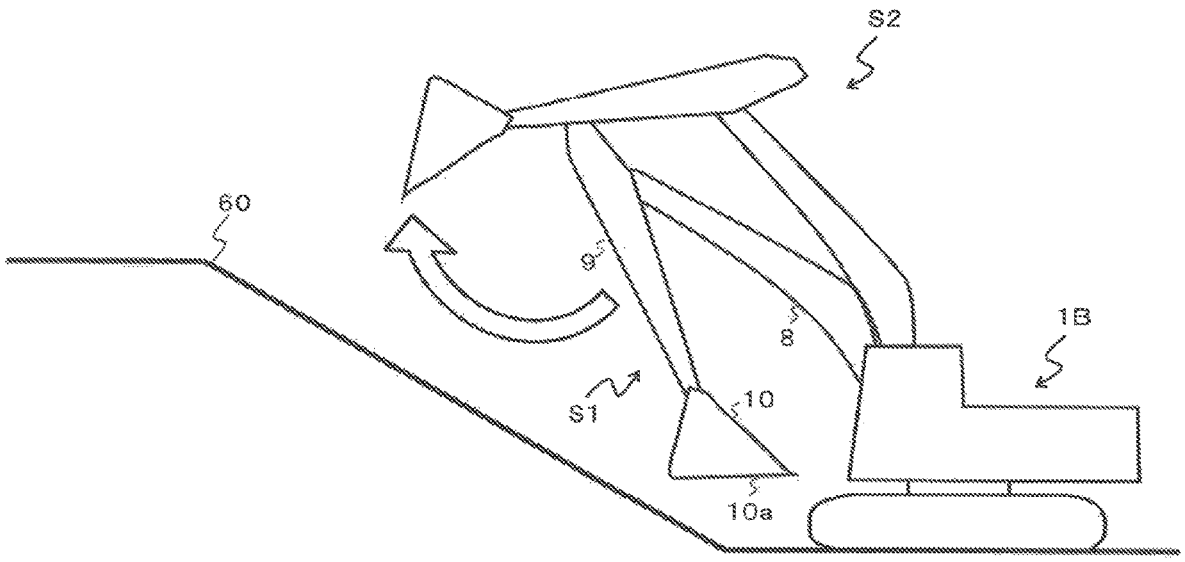
FIG. 8 is a diagram illustrating a work preparation operation (bucket positioning work) for arm work based on arm crowding.
Figure 9:
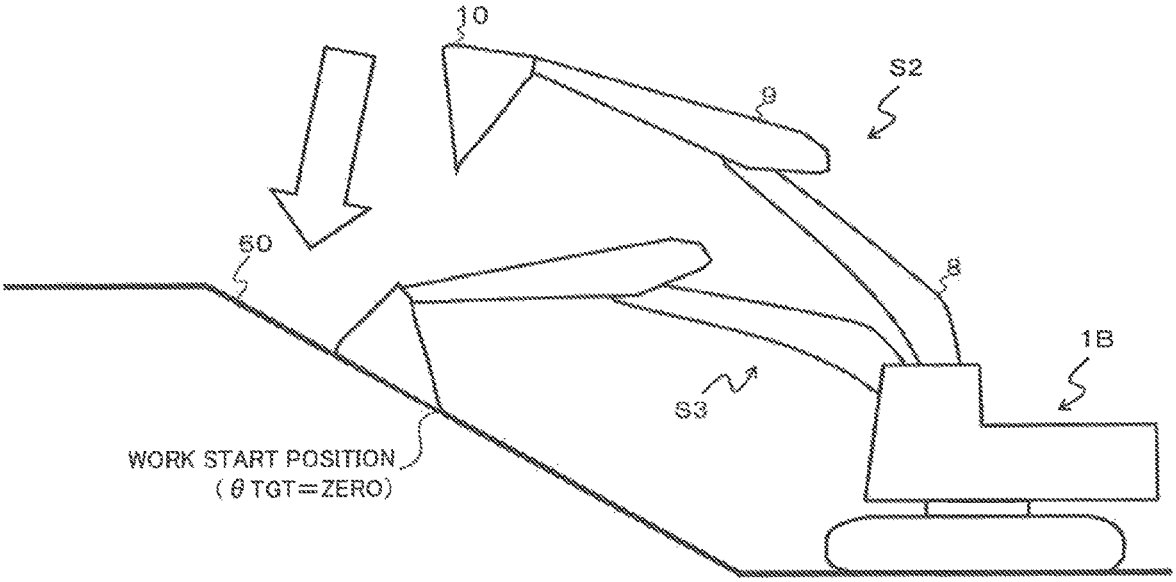
FIG. 9 is a diagram illustrating a work preparation operation (bucket positioning work) for arm work based on arm crowding.

An exemplary work preparation operation (bucket positioning work) for arm work based on arm crowding is illustrated in FIGS. 8 and 9. FIGS. 8 and 9 illustrate an exemplary work preparation operation during finishing work for slope excavation.

For example, in finishing work for slope excavation, it is preferable that the bucket 10 be linearly moved along the target surface 60 to smooth the target surface 60 while the bottom surface 10*a* of the bucket 10 is angled substantially parallel to the slant of the target surface 60 (i.e., the bucket angle with respect to target surface θ is zero). Therefore, at the work start position, it is preferred that the bottom surface 10*a* of the bucket 10 be angled substantially parallel to the slant of the target surface 60. Here, the bottom surface 10*a* of the bucket 10 is a surface of the bucket 10 that corresponds to a straight line joining the front end of the bucket 10 to its rear end.

The work preparation operation (bucket positioning work) in the above case is a series of operations that start in a state S1 (see FIG. 8) and transition through a state S2 (see FIGS. 8 and 9) to a state 3 (see FIG. 9). In the state S1, the arm 9 is fully crowded, and the bucket 10 is positioned apart from the target surface 60. In the state S2, the arm 9 is moved in a dumping direction so that the bucket 10 is approaching the target surface 60. In the state S3, the bucket 10 is stopped at a predetermined position referenced to the target surface 60 so that the bucket angle with respect to target surface coincides with a setting θTGT (=zero). FIG. 8 illustrates a transition from the state S1 to the state S2. FIG. 9 illustrates a transition from the state S2 to the state S3.

In the state S1 in which the work preparation operation starts, the arm 9 need not always be fully crowded as depicted in FIG. 8, but may be in any posture. The present invention is also applicable to a case where arm work can be performed by arm dumping (e.g., a case where spraying work is performed as depicted later in FIG. 22). In that case, the work starts in a state where the arm is crowded as in the state S1.

When the operation devices 45*a*, 45*b*, and 46*a* are operated, based on the position of the target surface 60, the posture of the front work device 1A, the position of the claw tip of the bucket 10, and the operation amounts of the operation devices 45*a*, 45*b*, and 46*a*, the boom control section 81*a* executes MC in order to control the operation of the boom cylinder 5 (boom 8) in such a manner that the claw tip (control point) of the bucket 10 is positioned on or above the target surface 60. The boom control section 81*a* computes the target pilot pressure for the flow control valve 15*a* of the boom cylinder 5. MC executed by the boom control section 81*a* will be described in detail later with reference to FIGS. 11 and 12.

The bucket control section 81*b* executes bucket angle control based on MC when the operation devices 45*a*, 45*b*, and 46*a* are operated. More specifically, when the operation determination section 81*c* determines that the front work device 1A is performing the work preparation operation, and the distance between the target surface 60 and the claw tip of the bucket 10 is equal to or smaller than a predetermined value, MC (bucket angle control) is executed to control the operation of the bucket cylinder 7 (bucket 10) in such a manner that the angle θ of the bucket 10 with respect to the target surface 60 coincides with the bucket angle with respect to target surface θTGT, which is preset by the target angle setting device 96. The bucket control section 81*b* computes the target pilot pressure for the flow control valve 15*c* of the bucket cylinder 7. MC executed by the bucket control section 81*b* will be described in detail later with reference to FIG. 10.

Based on the target pilot pressures for the flow control valves 15*a*, 15*b*, and 15*c*, which are outputted from the actuator control section 81, the solenoid proportional valve control section 44 computes commands for the solenoid proportional valves 54 to 56. When a pilot pressure (first control signal) based on an operator operation coincides with a target pilot pressure calculated by the actuator control section 81, a current value (command value) for the associated solenoid proportional valve 54 to 56 is zero so that the associated solenoid proportional valve 54 to 56 does not operate.

<Flow of Bucket Angle Control by Bucket Control Section 81*b* and Operation Determination Section 81*c*>

Figure 10:
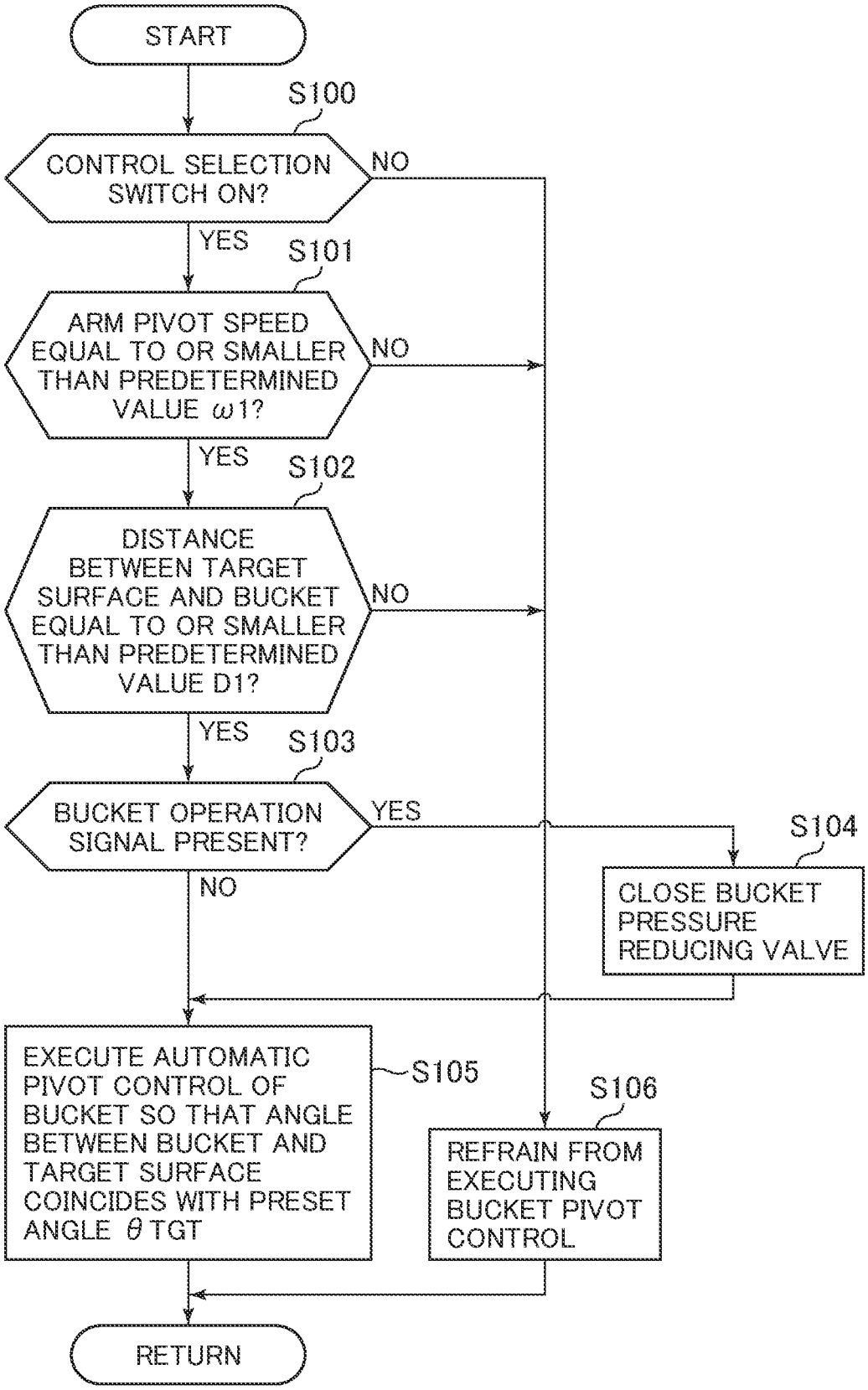
FIG. 10 is a flowchart illustrating bucket angle control that is executed by a bucket control section and operation determination section according to Embodiment 1.

FIG. 10 is a flowchart illustrating bucket angle control that is executed by the bucket control section 81*b* and the operation determination section 81*c*. First of all, the bucket control section 81*b* determines in step 100 whether the control selection switch 97 is turned ON (i.e., bucket angle control is enabled). If the control selection switch 97 is ON, processing proceeds to step 101.

In step 101, the operation determination section 81*c* determines whether the front work device 1A is engaged in the work preparation operation by checking whether the pivot speed of the arm 9 is equal to or smaller than a predetermined value ω1. The predetermined value ω1 is set in order to detect the point in time when an arm operation in the state S2 will end shortly or has already ended and thus a boom lowering operation in the state S3 will start shortly. If the arm pivot speed is equal to or smaller than the predetermined value ω1, the front work device 1A is determined to be engaged in the work preparation operation, and processing proceeds to step 102. The arm pivot speed used in step 101 may be obtained by presetting a correlation table defining the relationship between the pilot pressure for the flow control valve 15*b* and the arm pivot speed and then determining the arm pivot speed from the correlation table and the pilot pressure for the flow control valve 15*b*, which is detected by the operator operation sensor 52*a*. Alternatively, the arm pivot speed may be determined by time-differentiating the angle of the arm 9 that is detected by the work device posture sensor 50.

The predetermined value ω1 of the arm pivot speed should be preferably set to a sufficiently small value so that the speed of the arm 9 does not decrease even when MC of the bucket 10 or boom 8 is initiated to let the bucket 10 or the boom 8 move simultaneously with the arm 9 in a case where the operator operates the arm 9 to transition from the state S2 to the state S3. As far as the predetermined value ω1 is set in the above manner, the operator does not feel uncomfortable even if MC is initiated during an arm operation. Further, the predetermined value ω1 may be set to zero. When the predetermined value ω1 is set to zero, bucket angle control is executed to prevent the operation of the bucket 10 during an arm operation performed by the operator. Consequently, no uncomfortable feeling will be caused by a complex operation.

In step 102, the bucket control section 81*b* determines whether the distance D between the target surface 60 and the claw tip of the bucket 10 is equal to or smaller than a predetermined value D1. If the distance between the target surface 60 and the bucket 10 is equal to or smaller than the predetermined value D1, processing proceeds to step 103.

The predetermined value D1 of the distance between the bucket 10 and target surface 60 in the present embodiment determines the point in time at which MC is initiated to execute bucket angle control. It is preferable that the predetermined value D1 be set to a value as small as possible with a view toward reducing the uncomfortable feeling that may be given to the operator by the initiation of bucket angle control. For example, the predetermined value D1 may be equal to the length of the bottom surface 10*a* of the bucket 10. Further, the distance D between the target surface 60 and the claw tip of the bucket 10, which is used in step 102, can be calculated from the distance between the position (coordinates) of the claw tip of the bucket 10, which is computed by the posture computation section 43*b*, and a straight line including the target surface 60 stored in the ROM 93. A reference point of the bucket 10 on which the calculation of the distance D is based need not always be the bucket claw tip (the front end of the bucket 10). The reference point may be a point on the bucket 10 that minimizes the distance to the target surface 60, or may be at the rear end of the bucket 10.

In step 103, the bucket control section 81*b* determines, based on a signal from the operation amount computation section 43*a*, whether an operation signal for the bucket 10 is issued by the operator. If it is determined that an operation signal for the bucket 10 is issued, processing proceeds to step 104 and then to step 105. If, by contrast, it is determined that no operation signal is issued for the bucket 10, processing skips to step 105.

In step 104, the bucket control section 81*b* outputs a command so as to close the solenoid proportional valves (bucket pressing reducing valves) 56*a* and 56*b* in the pilot lines 146*a* and 146*b* for the bucket 10. This prevents the bucket 10 from being pivoted by an operator operation that is performed through the operation device 46*a*.

In step 105, the bucket control section 81*b* outputs a command so as to open the solenoid proportional valves (bucket pressure increasing valves) 56*c* and 56*d* in the pilot line 148*a* for the bucket 10, and controls the bucket cylinder 7 so that the bucket angle with respect to target surface coincides with the setting θTGT. Bucket angle control starts at the point in time when the distance D reaches the predetermined value D1. However, a control algorithm should preferably be built so as to complete bucket angle control before the distance D reaches zero.

If it is determined in any of steps 100, 101, and 102 that a condition is not satisfied (the query is answered "NO"), processing proceeds to step 106. In step 106, the angle of the bucket 10 (the bucket angle with respect to target surface) is not controlled so that no command is issued to the four solenoid proportional valves 56*a*, 56*b*, 56*c*, and 56*d*.

<Flow of Boom Raising Control by Boom Control Section 81*a*>

Figure 11:
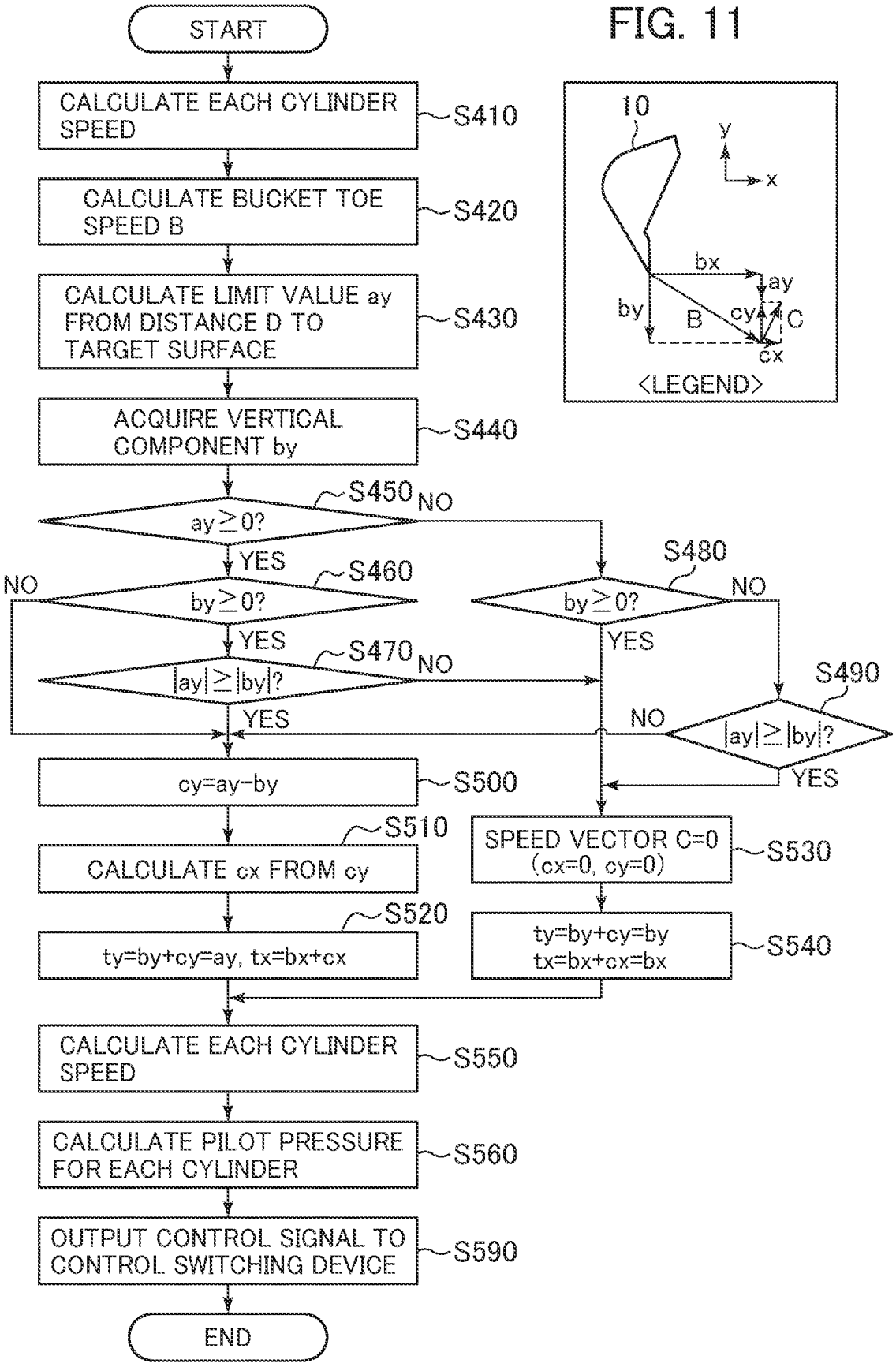
FIG. 11 is a flowchart illustrating boom raising control that is executed by a boom control section.
Figure 12:
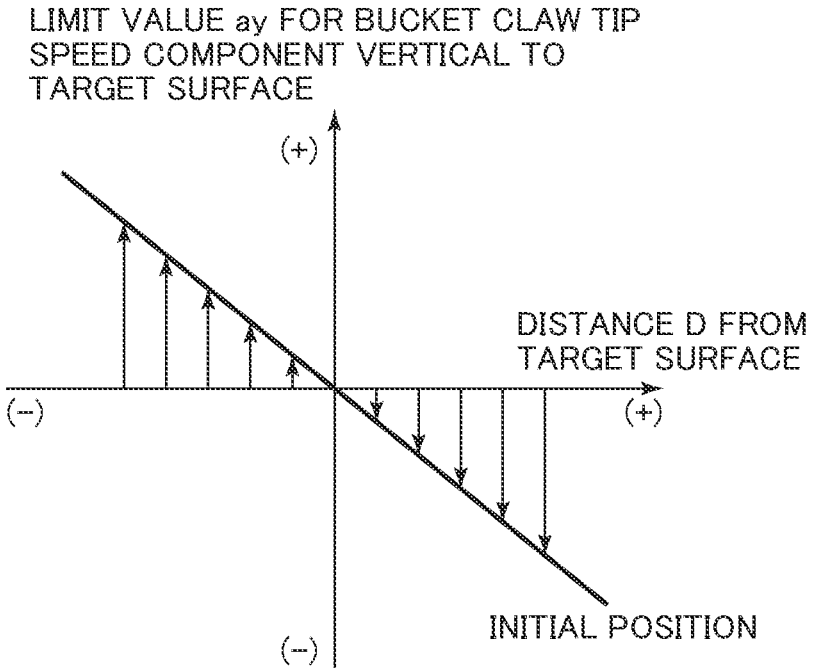
FIG. 12 is a diagram illustrating the relationship between a distance D and a limit value ay for the vertical component of a bucket toe speed.

The controller 40 according to the present embodiment executes boom raising control by the boom control section 81*a* as machine control in addition to bucket angle control by the above bucket control section 81*b*. The flow of boom raising control by the boom control section 81*a* is illustrated in FIG. 11. FIG. 11 is a flowchart illustrating how MC is executed by the boom control section 81*a*. Processing described in FIG. 11 starts when the operator operates the operation device 45*a*, 45*b*, and 46*a*.

In step 410, the boom control section 81*a* computes the operation speed (cylinder speed) of each hydraulic cylinder 5, 6, and 7 in accordance with an operation amount computed by the operation amount computation section 43*a*.

In step 420, based on the operation speeds of the hydraulic cylinders 5, 6, and 7, which are computed in step 410, and on the posture of the front work device 1A, which is computed by the posture computation section 43*b*, the boom control section 81*a* computes a speed vector B of the toe (claw tip) of the bucket operated by the operator.

In step 430, from the distance between the position (coordinates) of the claw tip of the bucket 10, which is computed by the posture computation section 43*b*, and a straight line including the target surface 60 stored in the ROM 93, the boom control section 81*a* calculates the distance D (see FIG. 5) from the toe of the bucket to the target surface 60 of a control target. Then, a limit value ay for a component of the speed vector of the bucket toe that is vertical to the target surface 60 is calculated based on the distance D and the graph of FIG. 12.

In step 440, the boom control section 81*a* acquires a vertical component by of the speed vector B, calculated in step 420, of the toe of the bucket operated by the operator. The acquired vertical component by is vertical to the target surface 60.

In step 450, the boom control section 81*a* determines whether the limit value ay calculated in step 430 is 0 or greater. It should be noted that xy coordinates are set as depicted in the upper right corner of FIG. 11. In the xy coordinates, it is assumed that the x-axis is parallel to the target surface 60 and positive in the rightward direction of FIG. 11, and that the y-axis is vertical to the target surface 60 and positive in the upward direction of FIG. 11. According to the legend in FIG. 11, the vertical component by and the limit value ay are negative, and a horizontal component bx, a horizontal component cx, and a vertical component cy are positive. Further, as is obvious from FIG. 12, when the limit value ay is 0, the distance D is 0, that is, the claw tip is positioned on the target surface 60, when the limit value ay is positive, the distance D is negative, that is, the claw tip is positioned below the target surface 60, and when the limit value ay is negative, the distance D is positive, that is, the claw tip is positioned above the target surface 60. If it is determined in step 450 that the limit value ay is 0 or greater (i.e., the claw tip is positioned on or below the target surface 60), processing proceeds to step 460. If, by contrast, the limit value ay is smaller than 0, processing proceeds to step 480.

In step 460, the boom control section 81*a* determines whether the vertical component by of the speed vector B of the claw tip operated by the operator is equal to or greater than 0. If the vertical component by is positive, it indicates that the vertical component by of the speed vector B is oriented upward. If the vertical component by is negative, it indicates that the vertical component by of the speed vector B is oriented downward. If it is determined in step 460 that the vertical component by is equal to or greater than 0 (i.e., the vertical component by is oriented upward), processing proceeds to step 470. If, by contrast, the vertical component by is smaller than 0, processing proceeds to step 500.

In step 470, the boom control section 81*a* compares the absolute value of the limit value ay with the absolute value of the vertical component by. If the absolute value of the limit value ay is equal to or greater than the absolute value of the vertical component by, processing proceeds to step 500. If, by contrast, the absolute value of the limit value ay is smaller than the absolute value of the vertical component by, processing proceeds to step 530.

In step 500, the boom control section 81*a* selects "cy=ay−by" as the equation for calculating the component cy vertical to the target surface 60 of a speed vector C of the toe of the bucket that should be generated by the operation of the machine-controlled boom 8, and calculates the vertical component cy in accordance with the selected equation, the limit value ay in step 430, and the vertical component by in step 440. Subsequently, the speed vector C capable of outputting the calculated vertical component cy is calculated, and its horizontal component is designated as cx (step 510).

In step 520, a target speed vector T is calculated. When a component of the target speed vector T that is vertical to the target surface 60 is ty, and a component horizontal to the target speed vector T is tx, the components are expressed by "ty=by+cy and tx=bx+cx," respectively. When the equation (cy=ay−by) in step 500 is substituted into the above equations, the target speed vector T is eventually expressed by "ty=ay and tx=bx+cx." That is to say, when step 520 is reached, the vertical component ty of the target speed vector is limited to the limit value ay, and a forced boom raising operation is initiated under machine control.

In step 480, the boom control section 81*a* determines whether the vertical component by of the speed vector B of the claw tip operated by the operator is equal to or greater than 0. If it is determined in step 480 that the vertical component by is equal to or greater than 0 (i.e., the vertical component by is oriented upward), processing proceeds to step 530. If, by contrast, the vertical component by is smaller than 0, processing proceeds to step 490.

In step 490, the boom control section 81*a* compares the absolute value of the limit value ay with the absolute value of the vertical component by. If the absolute value of the limit value ay is equal to or greater than the absolute value of the vertical component by, processing proceeds to step 530. If, by contrast, the absolute value of the limit value ay is smaller than the absolute value of the vertical component by, processing proceeds to step 500.

When step 530 is reached, the boom 8 need not be moved under machine control. Therefore, a front control device 81*d* sets the speed vector C to zero. In this instance, when based on the equations (ty=by+cy, tx=bx+cx) used in step 520, the target speed vector T is expressed by "ty=by and tx=bx." As a result, the target speed vector T coincides with the speed vector B based on an operator operation (step 540).

In step 550, the front control device 81*d* computes the target speeds of the hydraulic cylinders 5, 6, and 7 in accordance with the target speed vector T (ty, tx) determined in step 520 or 540. As is obvious from the foregoing description, if the target speed vector T does not coincide with the speed vector B in the case of FIG. 11, the target speed vector T is achieved by adding the speed vector C, which is generated when the boom 8 is moved under machine control, to the speed vector B.

In step 560, the boom control section 81*a* computes the target pilot pressures for the flow control valves 15*a*, 15*b*, and 15*c* of the hydraulic cylinders 5, 6, and 7 in accordance with the target speeds of the cylinders 5, 6, and 7, which are calculated in step 550.

In step 590, the boom control section 81*a* outputs the target pilot pressures for the flow control valves 15*a*, 15*b*, and 15*c* of the hydraulic cylinders 5, 6, and 7 to the solenoid proportional valve control section 44.

The solenoid proportional valve control section 44 controls the solenoid proportional valves 54, 55, and 56 in such a manner that the target pilot pressures are applied to the flow control valves 15*a*, 15*b*, and 15*c* of the hydraulic cylinders 5, 6, and 7. This causes the front work device 1A to perform an excavation operation. When, for example, the operator operates the operation device 45*b* to perform an arm crowding operation for horizontal excavation, the solenoid proportional valve 55*c* is controlled so as to prevent the toe of the bucket 10 from intruding into the target surface 60 and automatically raise the boom 8.

In the present embodiment, arm control (forced boom raising control) by the boom control section 81*a* and bucket control (bucket angle control) by the bucket control section 81*b* are executed as MC. However, arm control based on the distance D between the bucket 10 and the target surface 60 may alternatively be executed as MC.

<Operations and Advantages>

Operator operations performed on the hydraulic excavator having the above-described configuration in a case where a transition occurs from the state S1 (FIG. 8) through the state S2 (FIGS. 8 and 9) to the state S3 (FIG. 9) and MC executed by the controller 40 (boom control section 81*a* and bucket control section 81*b*) will now be described.

First of all, an operator operation performed to transition from the state S1 to the state S2 in FIG. 8 and MC executed by the controller 40 will be described. In order to cause the front work device 1A to transition from the state S1 to the state S2, the operator combines a dumping operation of the arm 9 with a raising operation of the boom 8 so as to prevent the bucket 10 from intruding into a position below the target surface 60 due to the dumping operation of the arm 9. In this instance, the controller 40 does not allow the bucket control section 81*b* to execute bucket angle control (MC). Meanwhile, if it is determined that the dumping operation of the arm 9 causes the bucket 10 to intrude into the target surface 60, the boom control section 81*a* executes control (MC) so as to raise the boom 8 by issuing a command to the solenoid proportional valve 54*a*.

Next, an operator operation performed to transition from the state S2 to the state S3 as depicted in FIG. 9 and MC executed by the controller 40 will be described. In order to make a transition from the state S2 to the state S3, the operator causes the bucket 10 to approach the target surface 60 by lowering the boom 8. If, in this instance, a determination indicating that the front work device 1A is engaged in the work preparation operation is received from the operation determination section 81*c*, the bucket control section 81*b* causes the bucket 10 to pivot in a crowding or dumping direction by issuing a command to the solenoid proportional valve 56*c* or 56*d* so that the bottom surface 10*a* of the bucket 10 is substantially parallel to the target surface 60 (the bucket angle with respect to target surface coincides with the setting θTGT (=zero)).

That is to say, when the front work device 1A is engaged in the work preparation operation (e.g., between the state S2 and the state S3) in a situation where the bucket control section 81*b* is configured as described above, bucket angle control is executed at the point in time at which the distance D between the bucket 10 and the target surface 60 reaches a value equal to or smaller than the predetermined value D1 (i.e., at the point in time when the bucket 10 approaches the target surface 60). Thus, before the claw tip of the bucket 10 reaches the target surface 60, the bucket angle with respect to target surface can be set to the value θTGT, which is set by the target angle setting device 96. Therefore, bucket angle control is initiated so that the bucket angle with respect to target surface is easily controlled to the setting θTGT. In addition, the bucket angle control is prevented from being initiated in a situation where the claw tip of the bucket 10 is positioned away from the target surface 60. This makes it possible to relatively shorten the period during which an uncomfortable feeling is given to the operator.

Further, when a plurality of hydraulic actuators driven by a hydraulic fluid of the same hydraulic pump are simultaneously moved, the operation speeds of the hydraulic actuators generally tend to be lower than when one hydraulic actuator is moved. When the work preparation operation is performed, the positioning of the bucket 10 in a front-rear direction of the machine body is mainly achieved by the arm 9. Therefore, if MC is executed, at the time of an operation of the arm 9, for another hydraulic actuator that is driven by the hydraulic fluid of the same hydraulic pump as for the arm 9, the operator may feel uncomfortable because the operation speed of the arm 9 may decrease against an operator's intention. It should be noted in this regard that the present embodiment does not execute bucket angle control while the operation amount of the arm 9 is large (while the arm pivot speed is high). Consequently, the speed of the arm 9 does not decrease due to an operator operation. As a result, the operator can move the arm 9 without feeling uncomfortable.

Accordingly, when the work preparation operation for arm work is performed, the hydraulic excavator configured as described above makes it possible to quickly adjust the bucket angle with respect to target surface to the setting θTGT without giving an uncomfortable feeling to the operator. This results in increased work efficiency.

If the operator performs a crowding or dumping operation of the bucket 10 during a transition made from the state S2 to the state S3 as depicted in FIG. 9, a command may be issued to the solenoid proportional valve 56*a* or 56*b* so as to stop the crowding or dumping operation of the bucket 10, which is performed by the operator, and allow only the solenoid proportional valve 56*a* or 56*b* to operate to pivot the bucket 10. Further, as an alternative to pivoting the bucket 10 by issuing a command to the solenoid proportional valve 56*c* or 56*d*, the bucket 10 may be controlled to achieve a desired angle θTGT by issuing a command to the solenoid proportional valve 56*a* or 56*b* so as to reduce the pilot pressure for the crowding or dumping operation of the bucket 10, which is performed by the operator. Moreover, an instruction to the operator may be displayed in the above instance by the display device 53 disposed in the cab of the hydraulic excavator 1 in order to prompt the operator to perform a crowding operation (e.g., a full-crowding operation) or dumping operation (e.g., a full-dumping operation) of the bucket 10 until a desired bucket angle with respect to target surface θTGT is achieved.

Embodiment 2

In Embodiment 1, when the arm pivot speed is equal to or lower than the predetermined value ω1, the operation determination section 81*c* determines that the front work device 1A is engaged in the work preparation operation. In Embodiment 2, however, the front work device 1A is determined to be engaged in the work preparation operation when a component of the speed vector at the tip of the arm 9 that is vertical to the target surface 60 is oriented toward the target surface 60.

Figure 13:
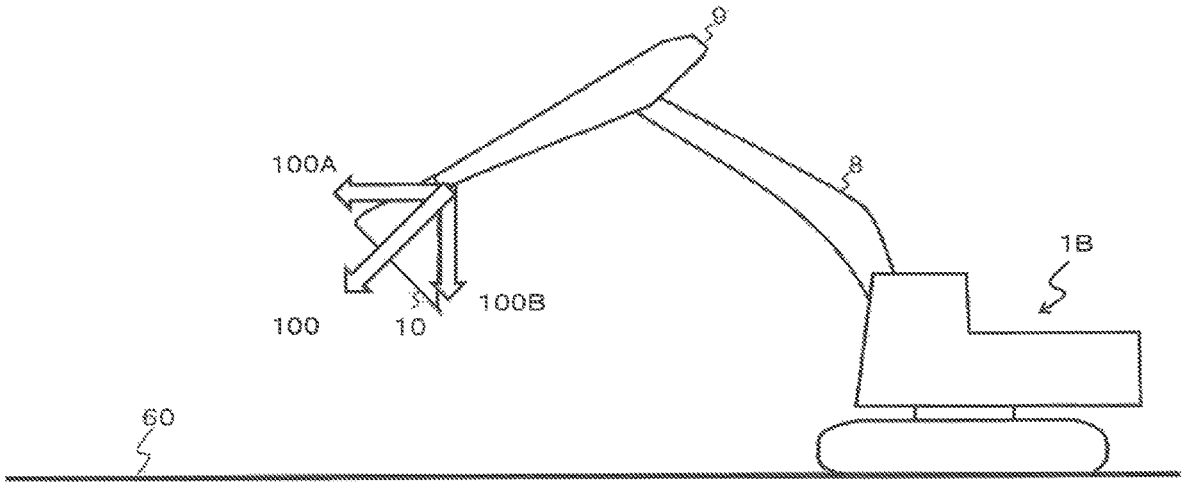
FIG. 13 is a diagram illustrating a speed vector that is generated at the tip of an arm by an operator's operation.

More specifically, in Embodiment 2, whether the angle of the bucket 10 is to be subjected to MC to achieve a desired bucket angle with respect to target surface θTGT is determined based on the direction of a speed vector 100 (see FIG. 13) generated by an operator operation, and bucket angle control is executed when the speed vector 100 is determined to have a component oriented toward the target surface 60. As depicted in FIG. 13, the speed vector 100 is generated by an operator operation and owned by the front work device 1A. Portions identical with those in the foregoing embodiment will not be redundantly described. This also applies to the description of the other embodiments.

<Flow of Bucket Angle Control by Bucket Control Section 81*b* and Operation Determination Section 81*c*>

Figure 14:
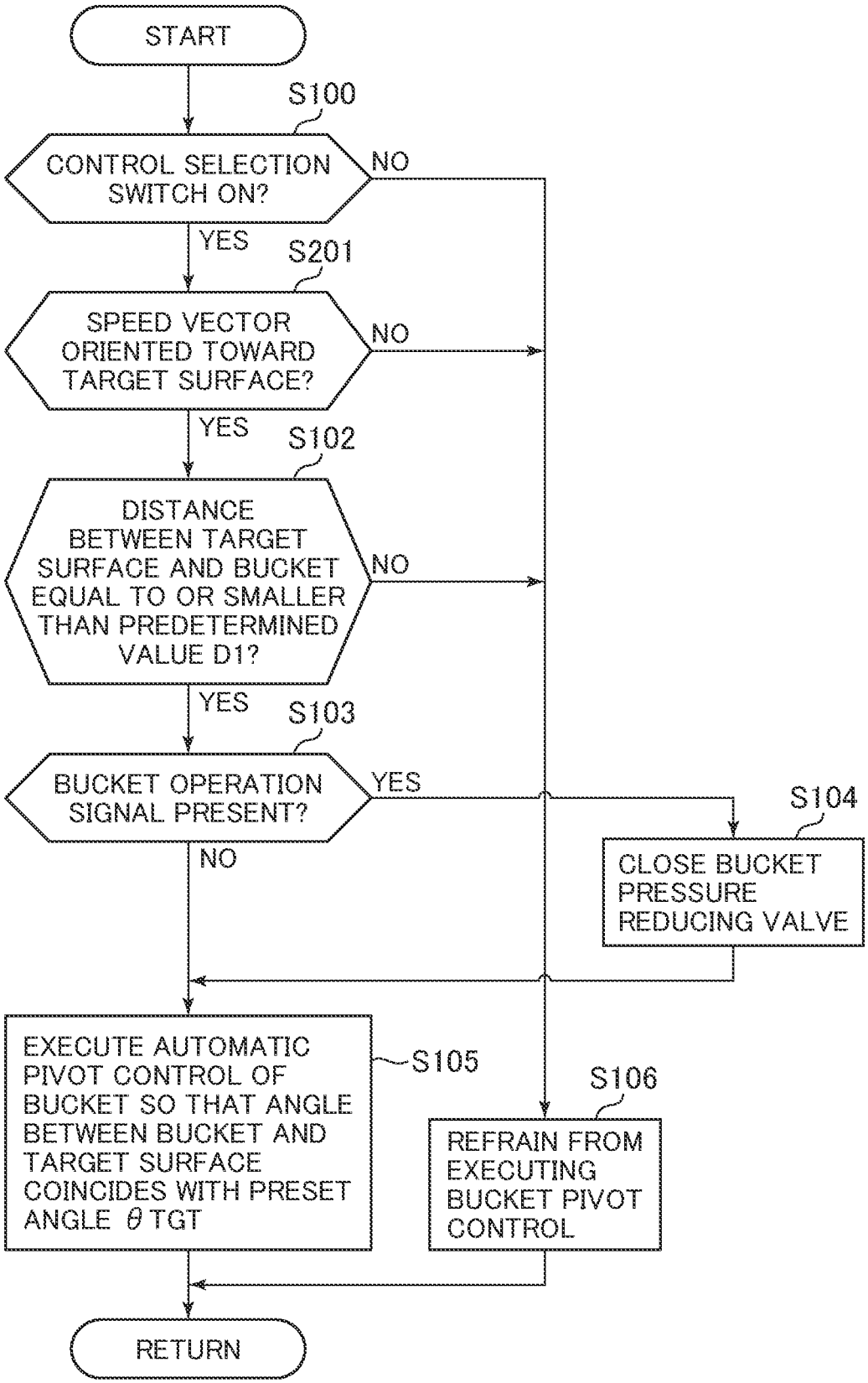
FIG. 14 is a flowchart illustrating bucket angle control that is executed by the bucket control section and operation determination section according to Embodiment 2.

FIG. 14 is a flowchart illustrating bucket angle control that is executed by the bucket control section 81*b* and operation determination section 81*c* according to Embodiment 2. Processing performed in steps 100, 102, 103, 104, 105, and 106 is the same as the processing illustrated in FIG. 10, and will not be redundantly described.

In step 201 of FIG. 14, the operation determination section 81*c* determines whether the speed vector 100 of the bucket pin, which is generated by an operator operation, is oriented toward the target surface 60. The speed vector 100 can be resolved into a component horizontal to the target surface 60 (a horizontal component) 100A and a component vertical to the target surface 60 (a vertical component) 100B. When the vertical component 100B is oriented toward the target surface 60, it can be determined that the speed vector 100 is oriented toward the target surface 60. If it is determined that the speed vector 100 is oriented toward the target surface 60, the front work device 1A is determined to be engaged in the work preparation operation for moving the bucket 10 to the work start position, and processing proceeds to step 102. If, by contrast, it is determined that the speed vector 100 is not oriented toward the target surface 60, the front work device 1A is determined to be not engaged in the work preparation operation, and processing proceeds to step 106.

The speed vector 100 used for determination in step 201 can be calculated by converting the pilot pressure acquired from the operator operation sensor 52*a* into a cylinder speed through the use of the correlation table, which is indicative of the correlation between pilot pressure and cylinder speed and stored in the controller 40, and geometrically converting the cylinder speed into an angular speed of the front work device 1A.

Figure 15:
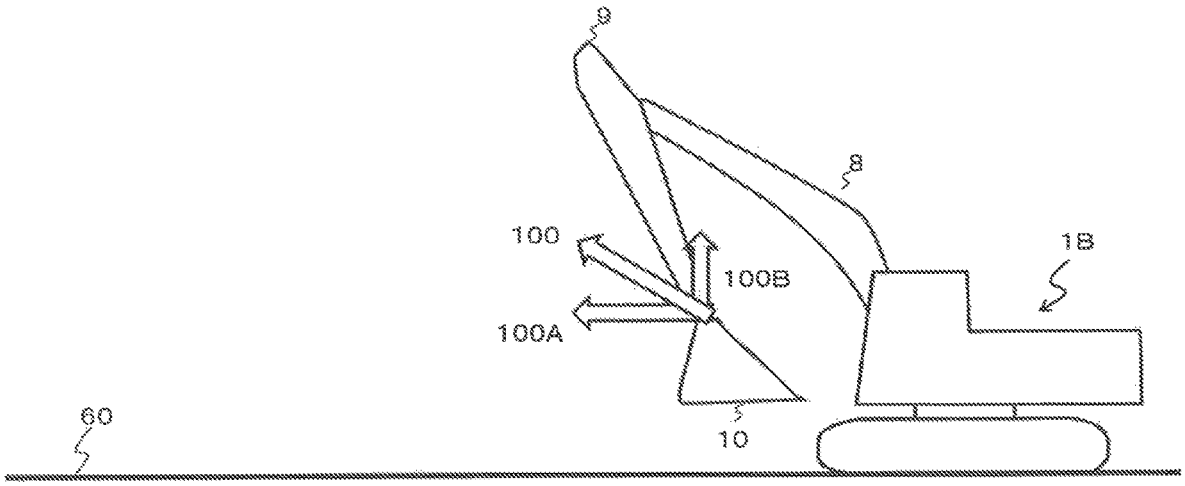
FIG. 15 is a diagram illustrating a speed vector that is generated at the tip of the arm by an operator's operation.

If, as depicted in FIG. 15, the vertical component 100B of the speed vector 100 is not oriented toward the target surface 60, it is conceivable that the operator is not operating the front work device 1A for the purpose of performing the work preparation operation (bucket positioning work). Therefore, bucket angle control is executed according to an operator's intention of performing positioning work only when the speed vector 100 generated by an operator operation is determined to be oriented toward the target surface 60 as indicated in FIG. 14. Consequently, bucket angle control can be executed without giving an uncomfortable feeling to the operator, as is the case with Embodiment 1.

The above description deals with, as an example, the speed vector 100 generated at the bucket pin (the tip of the arm 9). However, an alternative is to calculate the speed vector generated at the toe of the bucket 10 or at some other reference point on the bucket and execute control by using the vertical component of the calculated speed vector that is vertical to the target surface.

Embodiment 3

Embodiment 3 is characterized in that a boom lowering operation and an arm dumping operation are detected by adding steps 301 and 302 to the flowchart of FIG. 10, which describes the processing performed by the bucket control section 81*b* according to Embodiment 1. This permits Embodiment 3 to detect the work preparation operation (bucket positioning work) with higher accuracy.

Figure 16:
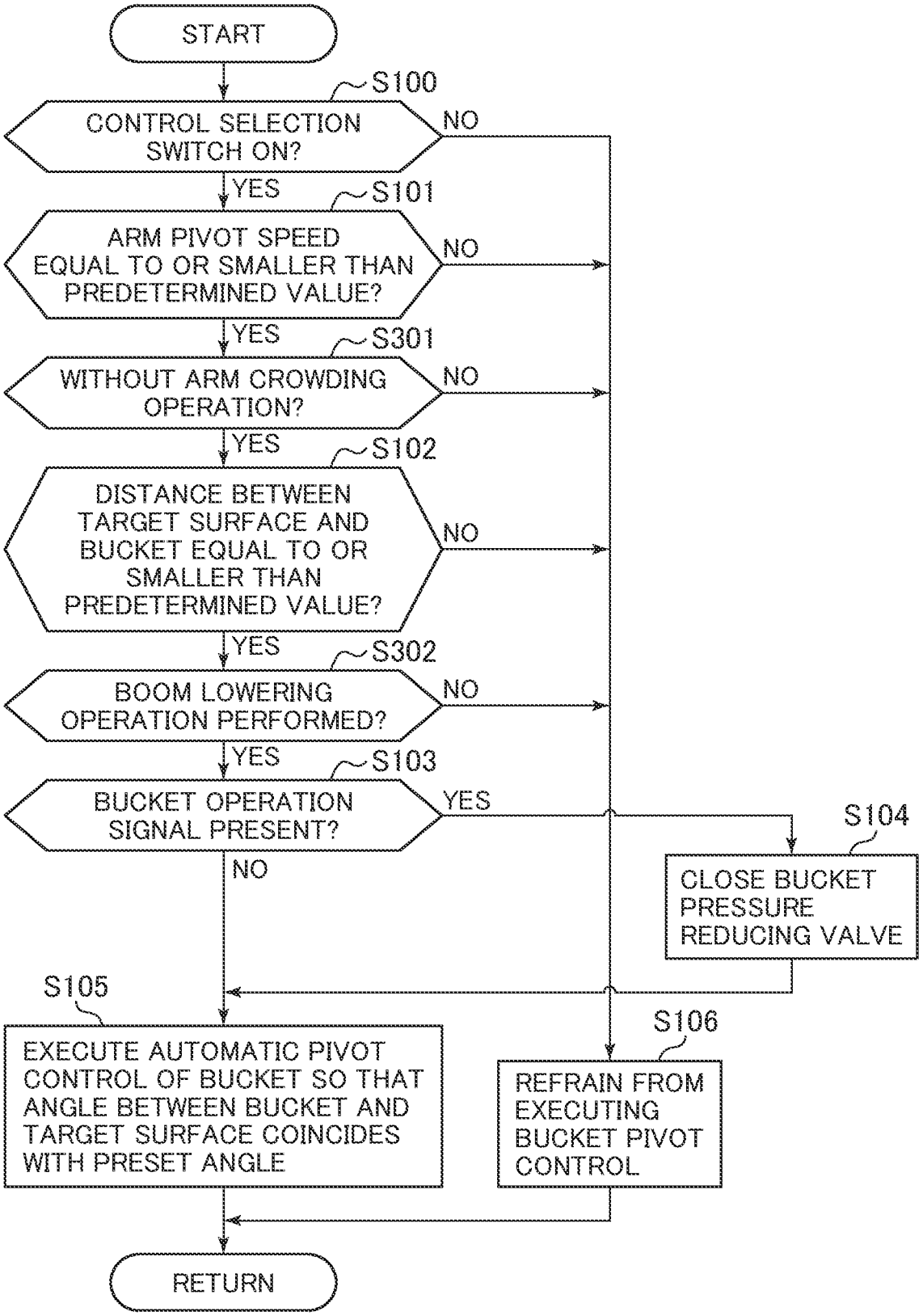
FIG. 16 is a flowchart illustrating bucket angle control that is executed by the bucket control section and operation determination section according to a third embodiment.

FIG. 16 is a flowchart illustrating bucket angle control that is executed by the bucket control section 81*b* and operation determination section 81*c* according to Embodiment 3. Processing steps identical with those in the foregoing flowcharts are designated by the same reference characters as the corresponding processing steps and will not be redundantly described.

In step 301, the operation determination section 81*c* determines, based on a signal from the operation amount computation section 43*a*, whether the arm 9 is not operated by the operator or an arm dumping operation is performed by the operator. That is to say, the operation determination section 81*c* determines whether an arm crowding operation is not performed. In the work preparation operation, the arm 9 mainly performs a dumping operation, and then a boom lowering operation is performed to bring the bucket 10 closer to the target surface 60. Therefore, detecting whether or not an arm crowding operation is performed in step 301 makes it possible to determine with higher accuracy than in Embodiment 1 whether the front work device 1A is engaged in the work preparation operation. If the query in step 301 is answered "YES," the arm pivot speed in step 101 is determined to be the pivot speed of an arm dumping operation. If it is determined in step 301 that no arm crowding operation is performed, the front work device 1A is determined to be currently engaged in the work preparation operation, and then processing proceeds to step 102. If, by contrast, it is determined that an arm crowding operation is performed, the front work device 1A is determined to be not engaged in the work preparation operation, and then processing proceeds to step 106.

In step 302, which is performed subsequently to step 102, the operation determination section 81*c* determines, based on a signal from the operation amount computation section 43*a*, whether a boom lowering operation is performed by the operator. As mentioned earlier, in the work preparation operation, a boom lowering operation is performed to bring the bucket 10 closer to the target surface. Therefore, detecting whether or not a boom lowering operation is performed in step 302 makes it possible to detect with higher accuracy than in Embodiment 1 whether the front work device 1A is engaged in the work preparation operation. If it is determined in step 302 that a boom lowering operation is performed, processing proceeds to step 103.

As steps 301 and 302 are added to bucket angle control, the hydraulic excavator configured as described in conjunction with Embodiment 3 detects the work preparation operation with higher accuracy than in Embodiment 1. This makes it possible to further reduce an uncomfortable feeling given to the operator.

The order of performing steps 100, 101, 301, 102, and 302 in FIG. 16 may be changed as appropriate. Further, one or both of steps 301 and 302 may be added to the flowchart of FIG. 14.

Embodiment 4

Figure 17:
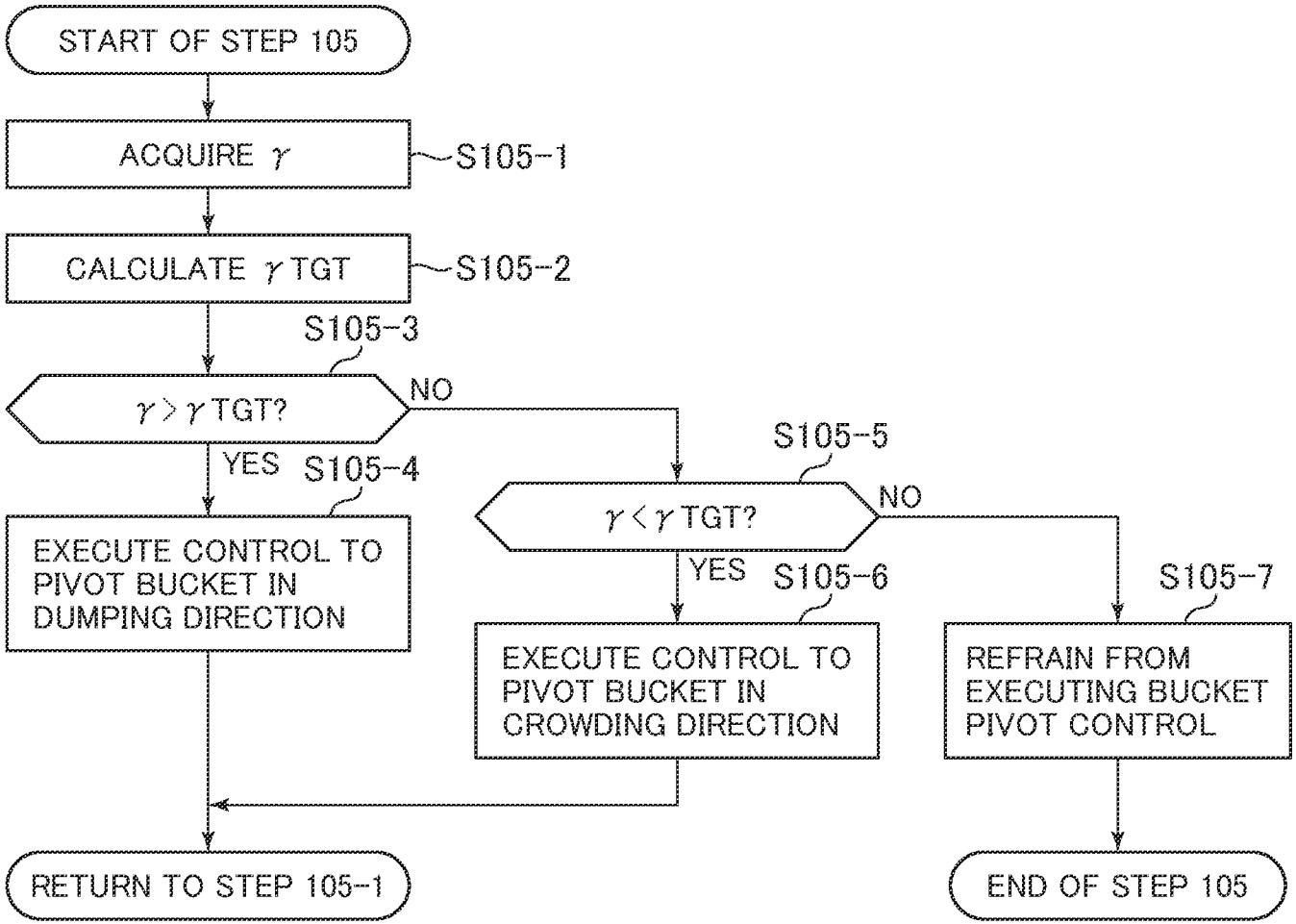
FIG. 17 illustrates the details of exemplary processing that is performed in step 105 of FIGS. 10, 14, and 16.

Embodiment 4 corresponds to an example of processing performed in step 105 of FIGS. 10, 14, and 16. FIG. 17 illustrates the details of the exemplary processing performed in step 105.

When step 105 begins in FIG. 10, 14, or 16, the bucket control section 81*b* starts operating as described in the flowchart of FIG. 17. First of all, in step 105-1, the bucket control section 81*b* acquires the pivot angle γ (see FIG. 5) of the bucket 10 with respect to the arm 9 from the posture computation section 43*b*.

Next, in step 105-2, the bucket control section 81*b* calculates a target value γTGT of the bucket pivot angle γ. The target value γTGT can be calculated from Equation (1) below by making use of the fact that the sum of α, β, γ, θTGT, and γTGT is 180 degrees. More specifically, the target value γTGT can be calculated in the manner described in the flowchart of FIG. 18.

$$\gamma TGT = 180 - (\alpha + \beta + \theta TGT) \quad \text{Equation (1)}$$

Figure 19:
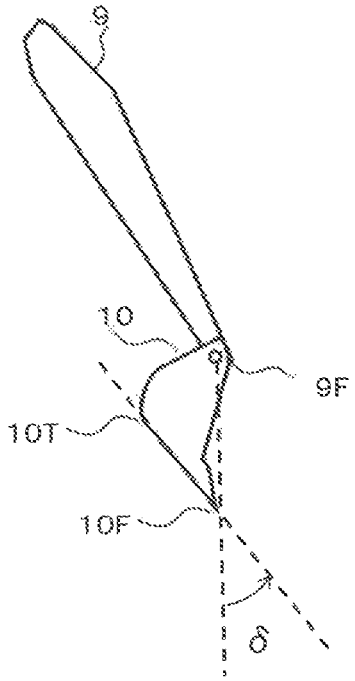
FIG. 19 is a diagram illustrating an angle δ.

As depicted in FIG. 19, δ in the above equation represents an angle between a straight line joining a connection point (coupling point) 9F between the arm 9 and the bucket 10 to the toe 10F of the bucket 10 and a straight line joining the toe 10F of the bucket 10 to the rear end 10T of the bucket 10. A value represented by δ is a fixed value that is determined by the shape of the bucket 10 and stored in the ROM 93. Further, as mentioned earlier, α represents the pivot angle of the boom 8 (see FIG. 5), β represents the pivot angle of the arm 9 (see FIG. 5), and θTGT represents the setting θTGT of the bucket angle with respect to target surface, which is determined by the target angle setting device 96. Although FIG. 5 illustrates a case where the target surface 60 is not inclined with respect to the excavator coordinate system, the target surface 60 may be inclined.

Figure 18:
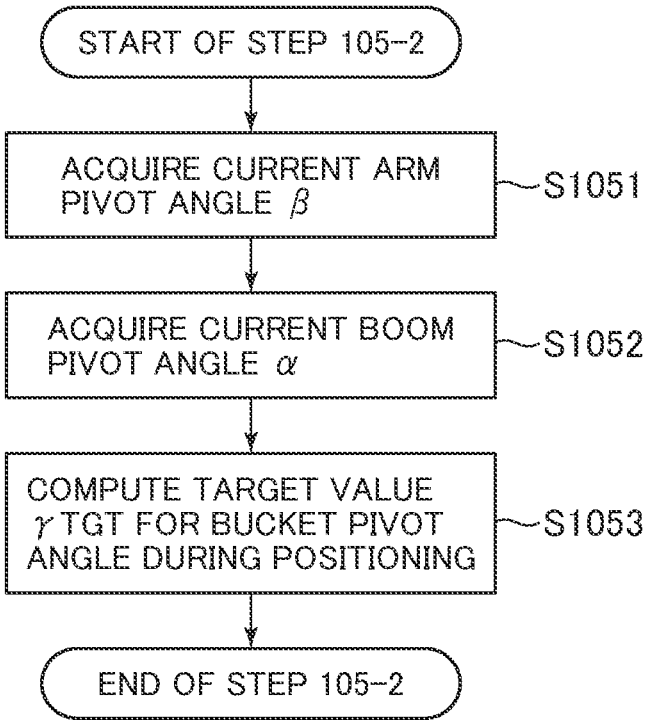
FIG. 18 is a flowchart illustrating the calculation of a target value γTGT of a bucket pivot angle.

Referring to the flowchart of FIG. 18, the bucket control section 81*b* acquires β and α from the posture computation section 43*b* (steps 1051 and 1052), calculates γTGT from δ in the ROM 93, θTGT acquired from the target angle setting device 96, and Equation (1) above (step 1053), and proceeds to step 105-3.

In step 105-3, the bucket control section 81*b* compares the current bucket pivot angle γ with γTGT calculated in step 105-2. If the result of comparison in step 105-3 indicates that γ is greater than γTGT, processing proceeds to step 105-4. If any other result is obtained, processing proceeds to step 105-5.

In step 105-4, the bucket control section 81*b* issues a command for the solenoid proportional valve 56*d* to the solenoid proportional valve control section 44 in order to pivot the bucket 10 in the dumping direction and thus decrease the pivot angle γ. Upon completion of step 105-4, the bucket control section 81*b* returns to step 105-1.

In step 105-5, the bucket control section 81*b* compares γ with γTGT. If γ is smaller than γTGT, processing proceeds to step 105-6. If γ is not smaller than γTGT, processing proceeds to step 105-7.

In step 105-6, the bucket control section 81*b* issues a command for the solenoid proportional valve 56*c* to the solenoid proportional valve control section 44 in order to pivot the bucket 10 in the crowding direction and thus increase the pivot angle γ. Upon completion of step 105-6, the bucket control section 81*b* returns to step 105-1.

In step 105-7, the bucket control section 81*b* terminates step 105 without controlling the pivot of the bucket because the pivot angle γ of the bucket is equal to the target value γTGT of the pivot angle γ.

Performing the above processing makes it possible to execute control so that the bucket pivot angle γ coincides with the target value γTGT. Therefore, control can be executed so that the bucket angle with respect to target surface coincides with the setting θTGT.

Figure 20:
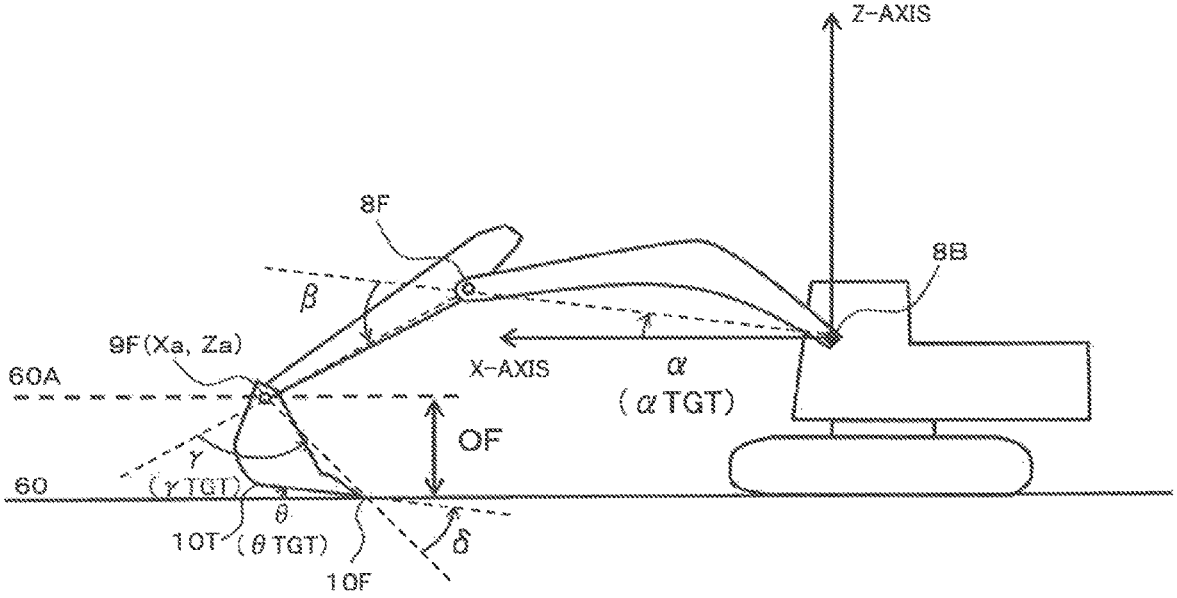
FIG. 20 is a state diagram illustrating a hydraulic excavator in a state where bucket angle control is executed to set a bucket in a final posture at a work start position.

Further, in step 105-2, the pivot angle γTGT of the bucket may be calculated as described below. FIG. 20 illustrates a hydraulic excavator in a state where bucket angle control is executed to set the bucket 10 in a final posture at the work start position. FIG. 20 also depicts the target surface 60, which serves as a positioning target for the bucket 10 at the time of positioning, and an offset target surface 60A. The offset target surface 60A is obtained by offsetting the target surface 60 by an offset amount OF and used as a target position of the connection point 9F at the time of positioning.

γTGT is calculated from Equation (2) below. β, δ, and θTGT in Equation (2) are known values. Therefore, when αTGT is calculated, γTGT can be calculated. The offset amount OF is uniquely determined from dimensional information about the bucket 10 when the setting θTGT of the bucket angle with respect to target surface is specified. For example, the offset amount OF=L3 sin(θTGT+δ). In this instance, the height coordinate Za of the target position of the connection point 9F at the time of positioning is also uniquely determined, and the longitudinal coordinate Xa of the target position is determined in accordance with the pivot angle β of the arm 9 and the target value αTGT of the pivot angle of the boom 8. As the pivot angle β of the arm 9 is determined by an operator operation, it is possible to compute the pivot angle αTGT of the boom 8 that should be eventually achieved at the time of positioning. Here, γTGT is calculated as described in the flowchart of FIG. 21.

$$\gamma TGT=180-(\alpha TGT+\beta+\delta+\theta TGT) \quad \text{Equation (2)}$$

Figure 21:
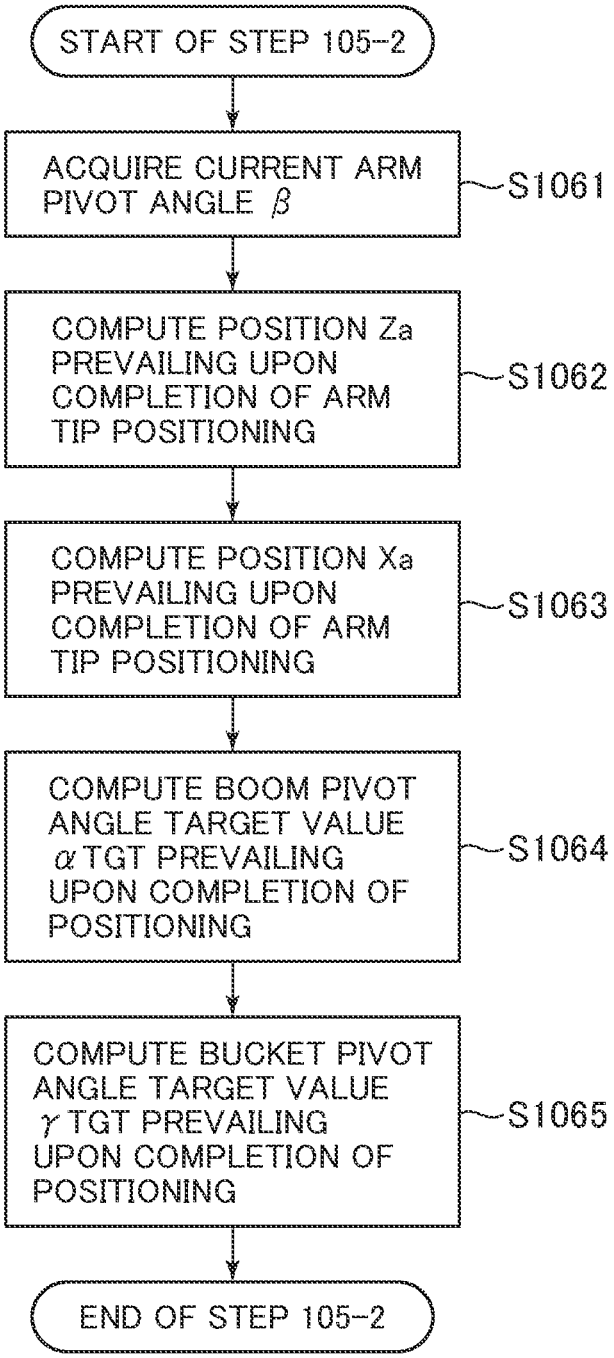
FIG. 21 is a flowchart illustrating the calculation of the target value γTGT of the bucket pivot angle.

Referring to the flowchart of FIG. 21, first of all, the bucket control section 81*b* acquires the pivot angle β of the arm 9 in step 1061. In step 1062, the height coordinate Za of the connection point 9F that is reached upon completion of positioning is calculated from the offset amount OF and the height information about the target surface 60. In step 1063, the longitudinal coordinate Xa of the connection point 9F that is reached upon completion of positioning is calculated. In step 1064, the target value αTGT of the pivot angle of the boom 8 that prevails upon completion of positioning is geometrically calculated by using Za calculated in step 1062 and Xa calculated in step 1063. The target value γTGT of the pivot angle of the bucket 10 that prevails upon completion of positioning can be finally calculated from the calculated αTGT, the known values of β, δ, and θTGT, and Equation (2) (step 1065).

When the target value γTGT of the pivot angle of the bucket 10 is calculated as described above, the pivot control amount of the bucket 10 can be reduced to shorten the time period during which the operator may feel uncomfortable.

<Modification of Embodiment 1>

Embodiment 1 executes bucket angle control at the point in time when the operation determination section 81*c* finds the front work device 1A in the work preparation operation and the distance D between the bucket 10 and the target surface 60 is equal to or smaller than the predetermined value D1. Meanwhile, a modification of Embodiment 1 executes bucket angle control at the point in time when the operation determination section 81*c* determines that the front work device 1A is engaged in the work preparation operation. The other portions have the same configuration as those in Embodiment 1 and will not be redundantly described.

Figure 23:
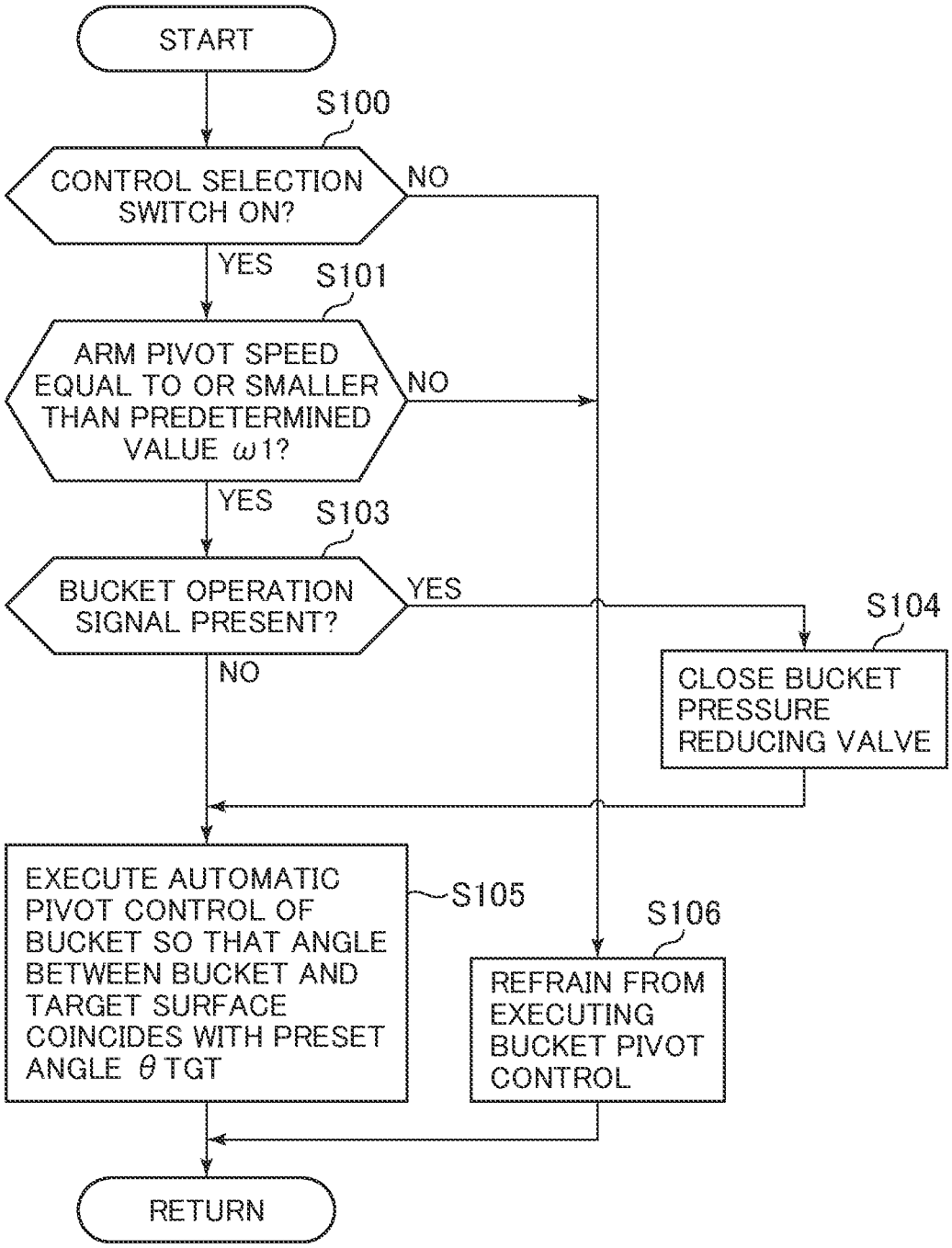
FIG. 23 is a flowchart illustrating bucket angle control that is executed by the bucket control section and operation determination section according to a modification of Embodiment 1.

FIG. 23 is a flowchart illustrating bucket angle control that is executed by the bucket control section 81*b* and operation determination section 81*c* according to the modification of Embodiment 1. The flowchart of FIG. 23 corresponds to a flowchart obtained by eliminating step 102 from the flowchart of FIG. 10. Steps identical with those in FIG. 10 will not be redundantly described.

In step 101, as is the case with Embodiment 1, whether the front work device 1A is engaged in the work preparation operation is determined by allowing the operation determination section 81*c* to check whether the pivot speed of the arm 9 is equal to or lower than the predetermined value ω1. If the arm pivot speed is equal to or lower than the predetermined value ω1, the front work device 1A is determined to be engaged in the work preparation operation, and processing proceeds to step 103.

In step 103, the bucket control section 81*b* determines, based on a signal from the operation amount computation section 43*a*, whether an operation signal for the bucket 10 is issued by the operator. If no operation signal is issued for the bucket 10, processing proceeds to step 105.

In step 105, the bucket control section 81*b* issues a command for opening the solenoid proportional valves (bucket pressure increasing valves) 56*c* and 56*d* in the pilot line 148*a* for the bucket 10, and controls the bucket cylinder 7 so that the bucket angle with respect to target surface coincides with the setting θTGT.

When the bucket control section 81*b* is configured as described above, bucket angle control is executed upon detection of the front work device 1A engaged in the work preparation operation in step 101 so that the bucket angle with respect to target surface can be set to the value θTGT, which is set by the target angle setting device 96. Therefore, the bucket angle with respect to target surface can be easily controlled to the setting θTGT by initiating bucket angle control.

The present modification is configured so that whether the front work device 1A is engaged in the work preparation operation is determined by allowing the operation determination section 81*c* to check whether the pivot speed of the arm 9 is equal to or lower than the predetermined value ω1. However, whether the front work device 1A is engaged in the work preparation operation may be determined under different conditions. For example, whether the front work device 1A is engaged in the work preparation operation may alternatively be determined by checking whether the pivot speed in a boom lowering direction is equal to or lower than a predetermined value ω2. Another alternative is to make the determination in step 201 of FIG. 14. Still another alternative is to add the condition in at least either step 301 or step 302 of FIG. 16 to the condition in step 101 and determine whether the front work device 1A is engaged in the work preparation operation.

[Supplementary Notes]

The present invention is not limited to the foregoing embodiments, but includes various modifications. For example, the foregoing embodiments have been described in detail in order to facilitate the understanding of the present invention. Therefore, the present invention is not limited to a configuration that includes all the elements described in conjunction with the foregoing embodiments.

For example, in the foregoing embodiments, whether the front work device 1A is engaged in the work preparation operation is mainly determined depending on whether the pivot speed of the arm 9 is equal to or lower than the predetermined value ω1 or whether a component of the speed vector of the arm 9 or bucket 10 that is vertical to the target surface 60 is oriented toward the target surface 60. However, the determination may alternatively be made depending on some other elements (e.g., temporal changes in the load on the hydraulic cylinders 5, 6, and 7).

Figure 22:
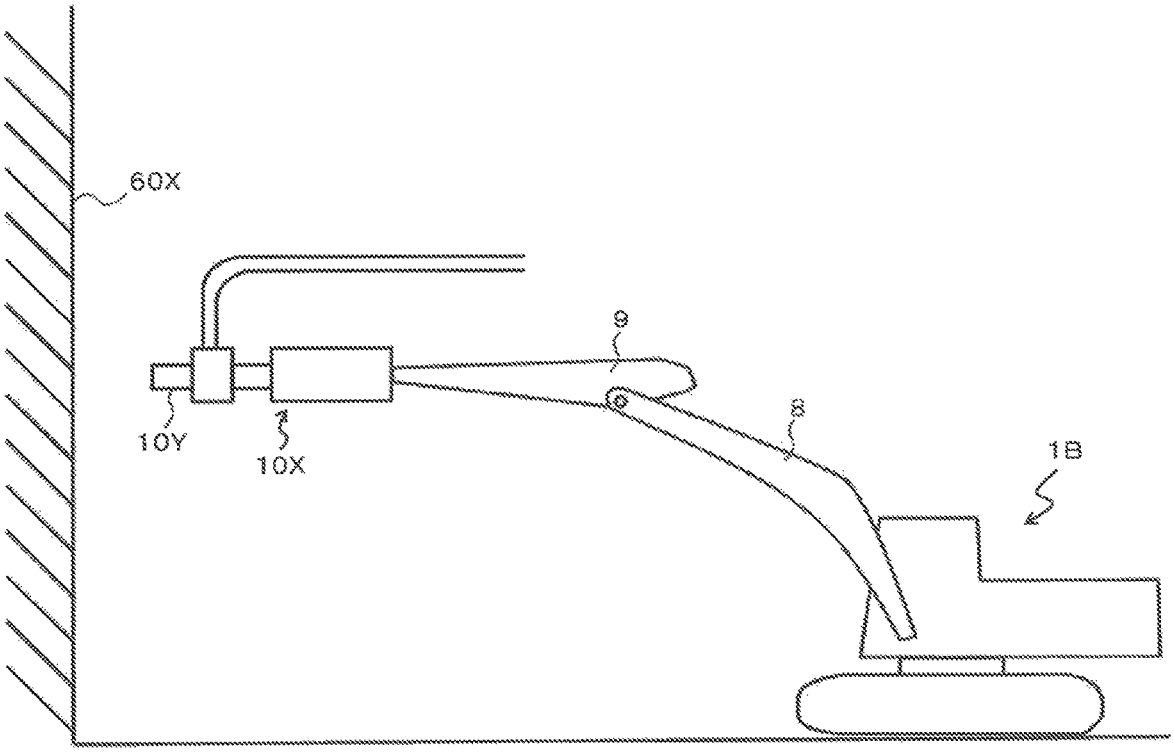
FIG. 22 is a schematic diagram illustrating a configuration of a work machine having a spray device as a work tool.

A hydraulic excavator having the bucket 10 as a work tool has been described in conjunction with the foregoing embodiments. However, the work tool is not limited to the bucket 10. The present invention is also applicable to a work machine having, for example, a spray device 10X as the work tool as depicted in FIG. 22. The spray device 10X sprays concrete, mortar, or other materials on a predetermined spraying surface (target surface) 60X.

Further, the bucket angle with respect to target surface has been described with reference to a case where the bottom surface of the bucket 10 is angled substantially parallel to the slant of the target surface 60 (i.e., a case where θTGT=0). However, the setting of the bucket angle with respect to target surface is not limited to such a case. For example, excavation work may be facilitated by placing the toe of the bucket 10 in an initial posture for intruding the toe of the bucket 10 into the target surface 60 by setting θTGT to a value greater than 0 (zero). Furthermore, when the spray device 10X depicted in FIG. 22 is attached to the work machine as the work tool, an angle at which the spraying surface 60X is orthogonal to the longitudinal axis of a nozzle 10Y may be set as θTGT (=90 degrees).

Moreover, the bucket position maintained by setting the bucket angle with respect to target surface to θTGT need not always be on the target surface 60, but may be on a surface that is similar in shape to the target surface 60 and obtained by offsetting the target surface 60 by a desired amount. When the angle of the work tool is controlled to θTGT on the above-mentioned offset surface, the ejection port of the nozzle 10Y can be continuously positioned at a desired distance from the spraying surface 60X while spraying work is performed with the spray device 10X depicted, for example, in FIG. 22. An input device allowing the operator to set an amount by which the target surface 60 is to be offset (an offset distance from the target surface 60) may be included as an interface.

The foregoing embodiments use angle sensors for detecting the angles of the boom 8, arm 9, and bucket 10. However, cylinder stroke sensors may alternatively be used instead of the angle sensors in order to calculate the posture information about an excavator. Further, the foregoing embodiments have been described with reference to a case where a hydraulic pilot excavator is employed. However, the foregoing embodiments are also applicable to an electric lever excavator as far as it is configured so as to control a command current generated from an electric lever. The foregoing embodiments have been described on the assumption that the speed vector of the front work device 1A is calculated from a pilot pressure based on an operator operation. However, the speed vector of the front work device 1A may alternatively be calculated from an angular speed that is determined by differentiating the angle of the boom 8, arm 9, or bucket 10.

When, in the foregoing embodiments, the operator brings the bucket 10 closer to the target surface 60 by lowering the boom 8 in a case where a transition is made from the state S2 to the state S3 as depicted in FIG. 9, the boom control section 81*a* may issue a command to the solenoid proportional valve 54*b* as needed to decelerate or stop the lowering operation of the boom 8 so that the bucket 10 does not intrude into the target surface 60 due to the operator's lowering operation on the boom 8.

For example, the elements of the above-described controller 40, the functions of the elements, and the processes executed by the elements may be partly or wholly implemented by hardware (e.g., by designing the logic for executing each function with an integrated circuit). Further, the elements of the above-described controller 40 may be each implemented by a program (software) that is read and executed by an arithmetic processing unit (e.g., a CPU) in order to perform the functions of the elements of the controller 40. Information concerning the program may be stored, for example, in a semiconductor memory (e.g., a flash memory or an SSD), a magnetic storage device (e.g., a hard disk drive), or a recording medium (e.g., a magnetic disk or an optical disk).

The invention claimed is:

1. A work machine that performs work by operating an arm after moving a work tool to a work start position, the work machine comprising:

a work device that includes a boom, the arm, and the bucket;

a plurality of hydraulic actuators that drive the work device;

an operation device that instructs the work device to operate in accordance with an operator's operation;

a target surface setting device that sets a target surface indicative of a target shape of a work target for the work device;

a target angle setting device that sets a target angle of the bucket; and a control device configured to:

perform bucket angle control as machine control to control a hydraulic actuator related to the bucket among the plurality of hydraulic actuators such that an angle of the bucket coincides with the target angle, and perform boom raising control as the machine control to control a hydraulic actuator related to the boom rising operation among the plurality of hydraulic actuators, based on a position of the target surface, a posture of the work device, and an operation amount of the operation device, such that a claw tip of the bucket is positioned on or above the target surface, wherein the control device further configured to:

determine, based on the operation performed on the operation device, whether the work device is engaged in a work preparation operation for moving the bucket to the work start position, when it is determined that the work device is engaged in the work preparation operation at the time of operation of the operation device, perform the bucket angle control and the boom raising control as the machine control, and when it is determined that the work device is not engaged in the work preparation operation at the time of operation of the operation device, perform the boom raising control as the machine control without performing the bucket angle control.

2. The work machine according to claim 1, wherein the control device further configured to perform the bucket angle control when the work device is determined to be engaged in the work preparation operation at the time of operation of the operation device and a distance between the target surface and the bucket is equal to or smaller than a predetermined value.

3. The work machine according to claim 1, wherein when a pivot speed of the arm is equal to or lower than a predetermined value or a component of a speed vector of the arm or of the bucket, the component being vertical to the target surface, is oriented toward the target surface, the control device determines that the work device is engaged in the work preparation operation.

4. The work machine according to claim 1, further comprising:

a control selection device that selectively enables or disables the machine control to be provided by the actuator control section.

5. The work machine according to claim 1, wherein the actuator control section executes the machine control such that the angle of the work tool with respect to the target surface coincides with the target angle at a desired position referenced to the target surface.

6. A work machine that performs work by operating an arm after moving a work tool to a work start position, the work machine comprising:

a work device that includes a boom, the arm, and the work tool;

a plurality of hydraulic actuators that drive the work device;

an operation device that instructs the work device to operate in accordance with an operator's operation; and a control device that includes an actuator control section for controlling at least one of the hydraulic actuators under predetermined conditions at a time of operation of the operation device is operated, wherein the control device further includes an operation determination section that determines, based on an operation performed on the operation device, whether the work device is engaged in a work preparation operation for moving the work tool to the work start position, when the pivot speed of the arm is zero, the operation determination section determines that the work device is engaged in the work preparation operation, and when the operation determination section determines that the work device is engaged in the work preparation operation at the time of operation of the operation device, the actuator control section executes machine control to control a target hydraulic actuator such that an angle of the work tool with respect to a target surface indicative of a target shape of a work target for the work device coincides with a preset target angle, the target hydraulic actuator being one of the hydraulic actuators and related to the work tool.

7. A work machine that performs work by operating an arm after moving a work tool to a work start position, the work machine comprising:

a work device that includes a boom, the arm, and the work tool;

a plurality of hydraulic actuators that drive the work device;

an operation device that instructs the work device to operate in accordance with an operator's operation; and a control device that includes an actuator control section for controlling at least one of the hydraulic actuators under predetermined conditions at a time of operation of the operation device is operated, wherein the control device further includes an operation determination section that determines, based on an operation performed on the operation device, whether the work device is engaged in a work preparation operation for moving the work tool to the work start position when a pivot speed for a dumping operation of the arm is equal to or lower than a predetermined value, or when the pivot speed of the arm is equal to or lower than the predetermined value and a lowering operation of the boom is performed, the operation determination section determines that the work device is engaged in the work preparation operation, and when the operation determination section determines that the work device is engaged in the work preparation operation at the time of operation of the operation device, the actuator control section executes machine control to control a target hydraulic actuator such that an angle of the work tool with respect to a target surface indicative of a target shape of a work target for the work device coincides with a preset target angle, the target hydraulic actuator being one of the hydraulic actuators and related to the work tool.

* * * * *